US006887106B2

(12) United States Patent
Noguchi et al.

(10) Patent No.: US 6,887,106 B2
(45) Date of Patent: May 3, 2005

(54) SHIELDING CONNECTOR

(75) Inventors: Hirotaka Noguchi, Yokkaichi (JP); Shiro Nishida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/704,065

(22) Filed: Nov. 7, 2003

(65) Prior Publication Data

US 2004/0132341 A1 Jul. 8, 2004

(30) Foreign Application Priority Data

| | | |
|---|---|---|
| Nov. 8, 2002 | (JP) | 2002-325159 |
| Nov. 12, 2002 | (JP) | 2002-327895 |
| Nov. 18, 2002 | (JP) | 2002-333903 |
| Nov. 18, 2002 | (JP) | 2002-333904 |
| Nov. 18, 2002 | (JP) | 2002-333905 |

(51) Int. Cl.[7] ..... H01R 9/03
(52) U.S. Cl. ..... 439/610; 439/98
(58) Field of Search ..... 439/610, 98, 99, 439/607, 608, 585, 275; 174/74 R, 75 C

(56) References Cited

U.S. PATENT DOCUMENTS

| | | | | |
|---|---|---|---|---|
| 4,634,204 A | * | 1/1987 | Detter et al. | 439/347 |
| 5,330,369 A | * | 7/1994 | Nozaki et al. | 439/489 |
| 5,823,824 A | | 10/1998 | Mitamura et al. | |
| 5,904,595 A | * | 5/1999 | Tanigawa | 439/610 |
| 5,911,599 A | * | 6/1999 | Masuda | 439/610 |
| 5,997,349 A | | 12/1999 | Yoshioka | |
| 6,270,377 B1 | * | 8/2001 | Miyazaki et al. | 439/610 |
| 6,468,105 B2 | | 10/2002 | Noguchi et al. | |
| 6,595,789 B2 | | 7/2003 | Oota et al. | |

FOREIGN PATENT DOCUMENTS

| | | |
|---|---|---|
| JP | 11-219758 | 8/1999 |
| JP | 2001-203024 | 7/2001 |
| JP | 2002-141145 | 5/2002 |

* cited by examiner

*Primary Examiner*—Alexander Gilman
(74) *Attorney, Agent, or Firm*—Gerald E. Hespos; Anthony J. Casella

(57) ABSTRACT

A shielding connector has a female and male housings (30; 60), each of which has an inner housing (31, 61) that accommodates terminal fittings (20; 25). Metal shells (50, 80) are mounted on the peripheries of the inner housings (31, 61) and electromagnetically shield the female and male terminal fittings (20; 25) when the housings (30; 60) are connected. The metal shells (50; 80) are configured to achieve secure mounting, effective shielding and a small cross section. A detector (90) is provided to ensure complete connection and is configured to prevent inadvertent separation of the housings (30; 60).

10 Claims, 36 Drawing Sheets

SHIELDING CONNECTOR

BACKGROUND OF THE INVENTION

1. Field of the Invention

The invention relates to a shielding connector and to a connector with a connection fit-on detecting function.

2. Description of the Related Art

Japanese Patent Application Laid-Open No. 11-219758 discloses a shielding connector that has a female housing and a male housing to be fitted thereon. The female and male housings each have an outer housing and an inner housing that is suspended in the outer housing through a plurality of ribs. The inner housings accommodate terminal fittings connected to the ends of shielding electric wires. A metal shell is fit on the periphery of the rear end of the inner housing and has slits for receiving the ribs. The metal shell is configured to contact the braided wire of the shielding electric wire. The corresponding female and male terminal fittings are connected to each other when the female and male housings have been fit together. At the same time, the projected ends of the female and male metal shells fit on each other and cover the area of the connection between the female and male terminal fittings. Thus, the female and male terminal fittings are shielded electromagnetically.

The inner housing of the above-described shielding connector is suspended in the outer housing by the ribs. Thus, it is necessary to form the slits on the metal shell. However, the slits align when the projected ends of the female and male metal shells are fit together and the metal shells are open at the positions where the slits align. As, a result, the shielding function of the connector deteriorates.

Each metal shell of the above-described connector is formed from a metal plate that is bent into a rectangular or oblong tube. A convexity at one end of the plate is forcibly fit to a concavity at the other end thereof to form the metal shell. A wide metal shell is liable to open at its widthwise center, and the metal shells will not fit smoothly together if the projected end of either shell opens. Additionally, a gap is formed between the metal shells if either shell opens, and the contact pressure of the contact plate interposed therebetween deteriorates. Thus the electrical connection is unstable and the connector has a poor shielding function.

The male shielding connector of JP 11-219758 is shown in FIG. 37 herein. With reference to FIG. 37, the male shielding connector m has an outer housing 1*m* and an inner housing 3*m*. A cavity 2*m* is formed in the inner housing 3*m* to accommodate a terminal fitting connected to the end of a shielding electric wire. A metal shell 4*m* is inserted into the outer housing 1*m* from its rear end (left side in FIG. 37) and is mounted on the periphery of the inner housing 3*m*. The metal shell 4*m* is configured for contacting the braided wire of the shielding electric wire.

A locking claw 5*m* is formed on the outer surface of the metal shell 4*m* to prevent the metal shell 4*m* from slipping off the periphery of the inner housing 3*m*. A lock 6*m* is formed on the inner peripheral surface of the outer housing 1*m* opposed to the outer surface of the metal shell 4*m* and a rib 7*m* extends to both sides of the lock 6*m*. The locking claw 5*m* passes the rib 7*m* and rides across the lock 6*m* as the metal shell 4*m* is inserted into the outer housing 1*m* and onto the periphery of the inner housing 3*m*. Thus, the locking claw 5*m* is locked to the front surface of the lock 6*m*, and the metal shell 4*m* is mounted on the periphery of the inner housing 3*m* without slipping off. The rib 7*m* at both sides of the lock 6*m* minimizes the elastic deformation of the locking claw 5*m* and enhances locking.

The locking construction of the shielding connector of FIG. 37 requires the stepped configuration of locking claw 6*m* and the rib 7*m* on the inner peripheral surface of the outer housing 1*m*. Thus the peripheral wall of the outer housing 1*m* is thick and hence the connector housing is radially large.

The female shielding connector of Japanese Patent Application Laid-Open No. 11-219758 is shown in FIGS. 38 and 39 herein. With reference to FIGS. 38 and 39 the female shielding connector f has an outer housing 1*f* and an inner housing 3*f*. The inner housing 3*f* is formed with a cavity 2*f* to accommodate a terminal fitting connected to the end of the shielding electric wire. A metal shell 4*f* is inserted into the outer housing 1*f* from its rear side (right side in FIG. 38) and is mounted on the periphery of the inner housing 3*f*. The metal shell 4*f* is configured to contact the braided wire of the shielding electric wire.

A lock 5*f* is formed as a step on the wall 2*f*A of the upper side of the cavity 2*f*, and the locking claw 6*f* is bent from the corresponding surface of the metal shell 4*f*. The metal shell 4*f* is inserted into the outer housing 1*f* from its rear side and is mounted on the periphery of the inner housing 3*f*. As a result, the locking claw 6*f* is pressed by the lock 5*f* and elastically deforms. The locking claw 6*f* returns to its original state due to its resiliency and is locked to the lock 5*f* when the metal shell 4*f* is inserted to the predetermined position. Thus, the metal shell 4*f* is mounted on the periphery of the inner housing 3*f* without slipping off.

The lock 5*f* is formed as a step on the upper wall 2*f*A of the cavity 2*f*. Thus, the diameter of the inner housing 3*f* is large, and the entire connector housing is large in the radial direction.

Japanese Patent Application Laid-Open No. 2002-141145 and FIG. 40 herein show another connector. With reference to FIG. 40, the connector includes a male housing 1*a* and a female housing 2*a* that can be fit on the male housing 1*a*. The female housing 2*a* defines a flexing space 3*a* and a locking arm 4*a* that deforms elastically into the flexing space 3*a* while the male housing 1*a* and the female housing 2*a* are being fitted together. The locking arm 4*a* returns elastically to its original state and is locked to the male housing 1*a* when the male and female housings 1*a* and 2*a* have been fit together normally for holding the male and female housings 1*a* and 2*a* together.

The female housing 2*a* also has a detector 5*a* that can move between a wait position (shown with two-dot chain line in FIG. 40) disposed away from the flexing space 3*a* and a detection position (shown with solid line in FIG. 40) disposed inside the flexing space 3*a*. The detector 5*a* can be pressed from the detection position toward the flexing space 3*a* when the male and female housings 1*a* and 2*a* are in a semi-fit-on state. However, the detector 5*a* strikes the locking arm 4*a* that has entered the flexing space 3*a* to prevent or limit the pressing of the detector 5*a*. The locking arm 4*a* moves away from the flexing space 3*a* when the male and female housings 1*a* and 2*a* are in a normal fit-on state. As a result, the detector 5*a* can advance to the detection position to detect the fit-on state of the male and female housings 1*a* and 2*a*.

The male and female housings 1*a* and 2*a* may have to be separated from each other for maintenance. For this purpose, a catch 5A at the rear end of the detector 5*a* can be gripped manually and pulled rearward. As a result, the detector 5*a* returns to the wait position, while the semi-locking of the housings 1*a* and 2*a* is being released. The locking arm 4*a* then can be deformed elastically to perform an unlocking operation, and the male and female housings 1*a* and 2*a* can be separated.

The connector of FIG. 40 has an advantage of permitting the detector 5*a* to be returned easily to the wait position so that the housings 1*a* and 2*a* can be unlocked and separated. However, foreign matter may press the catch 5A accidentally and return the detector 5*a* to the wait position. Thus, the housings 1*a* and 2*a* can be separated unintentionally.

The invention has been made in view of the above-described problems. Accordingly, it is an object of the present invention to allow a metal shell to enhance a shielding function.

It is another object of the invention to improve the locking construction of the metal shell and to thereby make the housing more compact.

A further object of the invention to achieve a smooth fit of the female and male metal shells on each other and to enhance the shielding function of a shielding connector.

It is a further object of the invention to prevent an inadvertent return of a detection member to a wait position.

SUMMARY OF THE INVENTION

The invention is a shielding connector with a female housing and a male housing to be fitted on the female housing. The female and male housings each include inner and outer housings. The inner housing is suspended through a connection and accommodates terminal fittings connected to ends of shielding electric wires.

A metal shell is inserted into a rear end of the outer housing and is configured to contact a braided wire of the shielding electric wire. The metal shell has slits for receiving the connections on a periphery of the inner housing. Projecting ends of the metal shells fit together and cover an area of connection between the terminal fittings. The slits of the metal shell of the female housing and the slits of the metal shell of the male housing are offset from each other in a widthwise direction. Therefore the projected end of the female metal shell closes the slits of the male metal shell, and the projected end of the male metal shell closes the slits of the female metal shell when the female and male metal shells are fit together. The entire region of the projected end of the female metal shell is covered with the male metal shell, and the entire region of the projected end of the male metal shell is covered with the female metal shell. Thus, shielding performance is enhanced.

Guides preferably are provided to guide the connections smoothly into the slits. Thus, the metal shell is mounted easily on the inner housing.

Each metal shell may be split and a joining portion may be formed on surfaces of the two split shells. The two split shells of the metal shell are connected to each other by caulking opposed side surfaces together. Therefore the metal shells will not open and keep a specified configuration.

A locking claw preferably projects from an inner surface of the metal shell, and a shell lock preferably is formed concavely inside the housing. The shell lock unremovably engages the locking claw. The conventional locking claw projects out, whereas the locking claw of the subject invention preferably projects in. Therefore, the housing of the subject invention does not require a thick outer wall to form the shell lock, and the housing is radially compact.

The housing preferably has a plurality of cavities for accommodating terminal fittings. The shell lock of the housing preferably is formed between two cavities. Thus, the shell lock utilizes dead space, and it is unnecessary to thicken the peripheral wall of the housing. Accordingly, the housing is radially compact.

The housing preferably comprises two shell locks formed on opposite peripheral surfaces of the housing. Thus, a strong and balanced force is maintained for preventing slip-off of the metal shell, while still keeping a compact housing.

A lance preferably is formed in the cavity of the terminal fitting accommodation part and unremovably locks the terminal fitting. The lock preferably is formed by cutting out a part of a wall that prevents an excessive elastic deformation of the lance. Therefore the connector prevents excessive elastic deformation of the lance while making the housing compact radially.

The male housing preferably has an opening prevention rib that contacts an outer surface of the projected end of the male metal shell and prevents the male metal shell from opening. Thus both metal shells can be fit together smoothly. Further there is no clearance between the metal shells after they are fit together.

A deformable contact plate preferably is raised from a portion near the projected end of the female metal shell and contacts an inner surface of the male metal shell. The contact plate maintains a desired contact pressure between the metal shells and stabilizes the electrical connection between the metal shells. Thus, a shielding function of the shielding connector is enhanced.

The projected end of the female metal shell forward of the contact plate is folded in and contacts a peripheral surface of the terminal fitting accommodation part on which the female metal shell is mounted. The folded portion forms a flexing space that permits the contact plate to deform elastically. Thus, the contact plate deforms elastically into the flexing space when the shells have been fit together and contacts the inner peripheral surface of the male metal shell. Accordingly, the contact plate secures an appropriate flexing amount and a high contact pressure by reducing the resistance in fitting the metal shells together. Further, the strength of the front end of the metal shell is increased.

A first of the housings preferably includes a resiliently deformable lock arm that deforms into a deformation space while the housings are being fit together. However, the lock arm returns resiliently to its original state and engages a second of the housings when both housings have been fit together.

The connector may have detector that is movable between a wait position spaced from the deformation space and a detection position disposed in the deformation space. The detector strikes the lock arm that is in the deformation space while the housings are being fit together. Thus, the detector cannot move from the wait position to the detection position. However, the detector can advance to the detection position when the housings have been fit together normally.

The detector preferably has a catch that can be used to return the detector toward the wait position. The catch is hidden at a rear side of the locking arm. However, part of the catch can be caught by a jig when the detector is at the detection position so that the detector can be returned intentionally to the wait position. Thus, foreign matter cannot press the catch.

An elastically deformable locking piece may be formed on the detector and is locked to a locking portion on the first housing. Thus, the detector is prevented from moving from the wait position to the detection position before the housings are fit together. The second housing has a release portion that engages and deforms the locking piece when the housings are fit together to unlock the locking piece from the lock. Thus it is possible to prevent the detector from being returned accidentally and to prevent the female and male housings from being separated unintentionally.

DETAILED DESCRIPTION OF THE PREFERRED EMBODIMENTS

Figure 1:
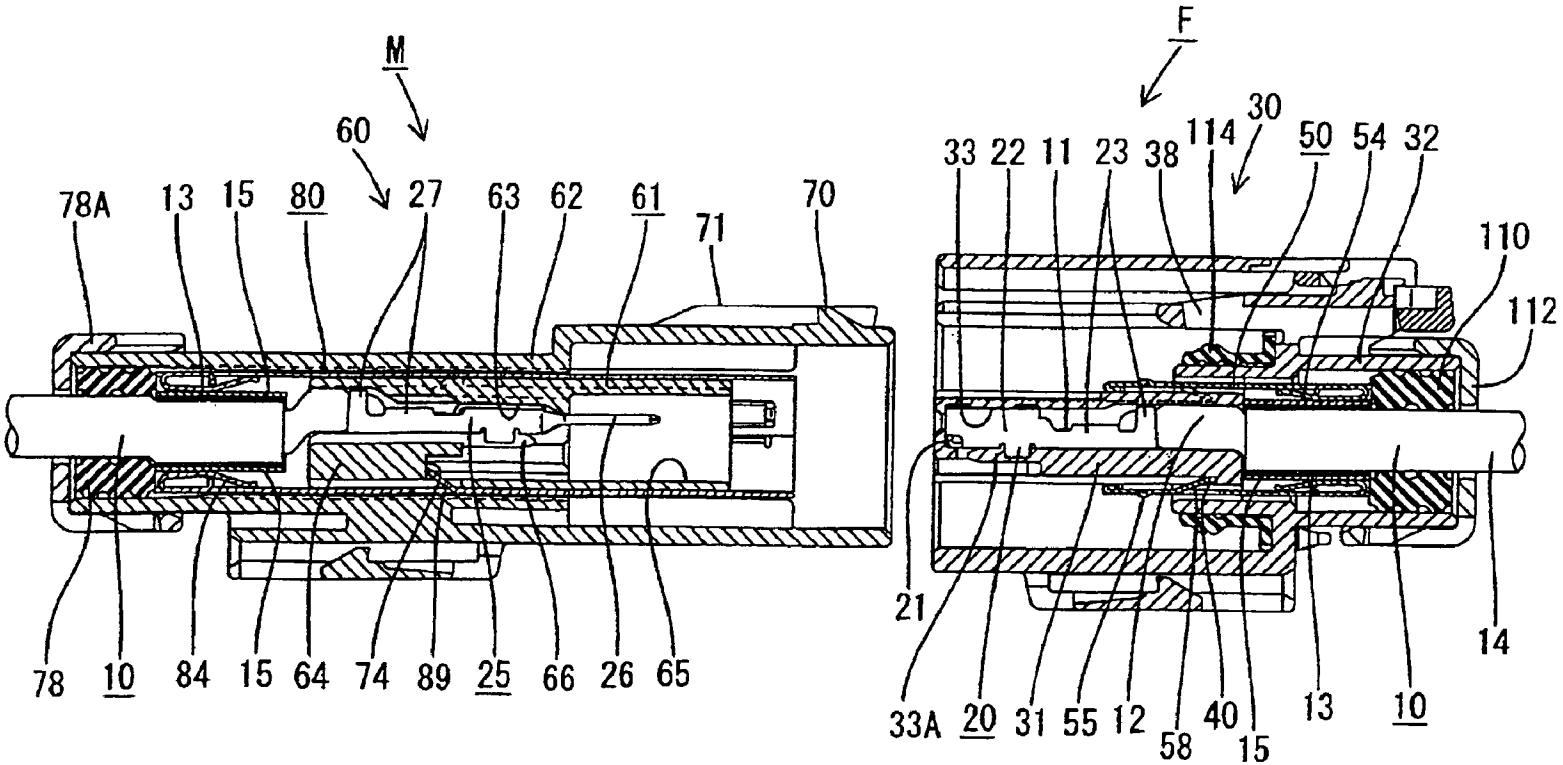
FIG. 1 is an exploded sectional view of the male and female connectors.
Figure 2:
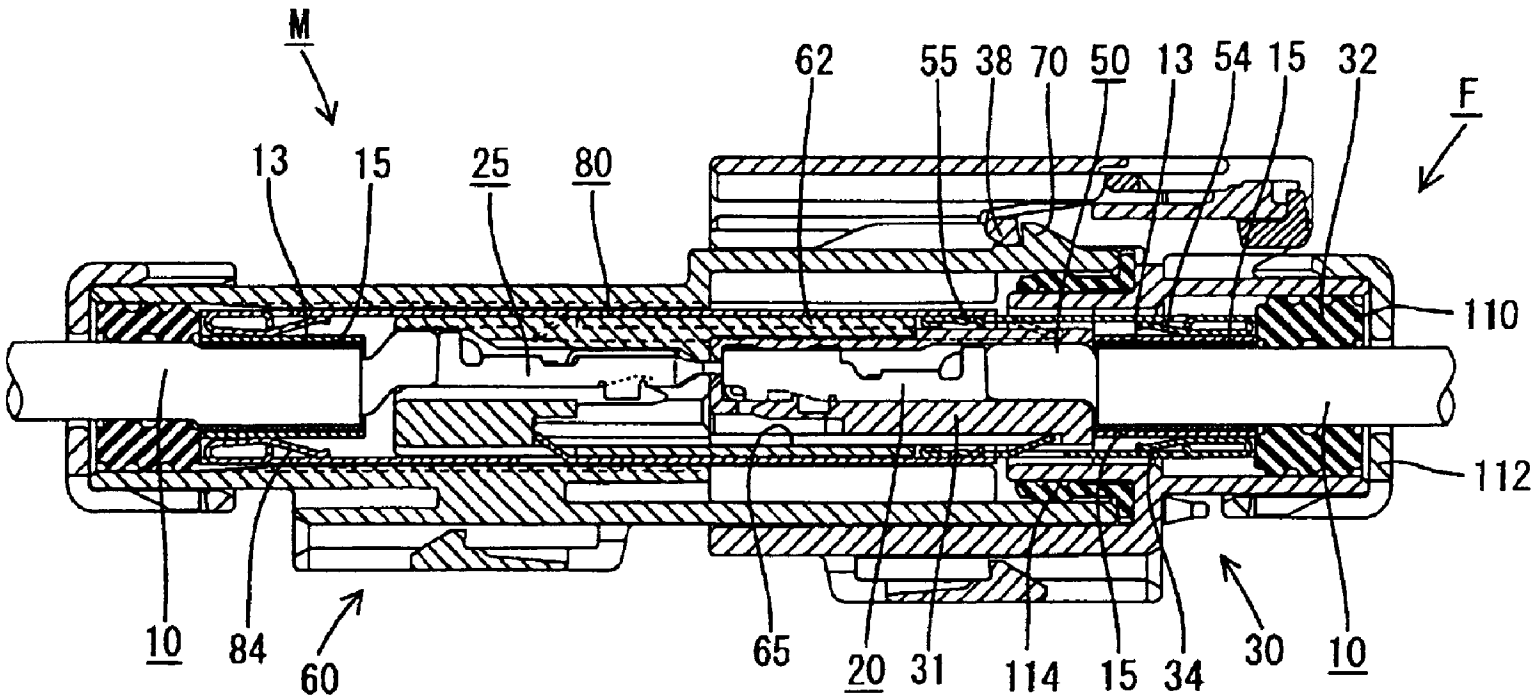
FIG. 2 is a cross sectional view of the male and female connectors in their fully connected condition.

A shielding connector according to a first embodiment of the invention is described below with reference to FIGS. 1 through 33. The shielding connector of this embodiment has a female connector F and a male connector M that can be fitted on the female connector F, as shown in FIGS. 1 and 2. A mating side of each of the female connector F and the male connector M is defined as the front side herein.

Figure 3:
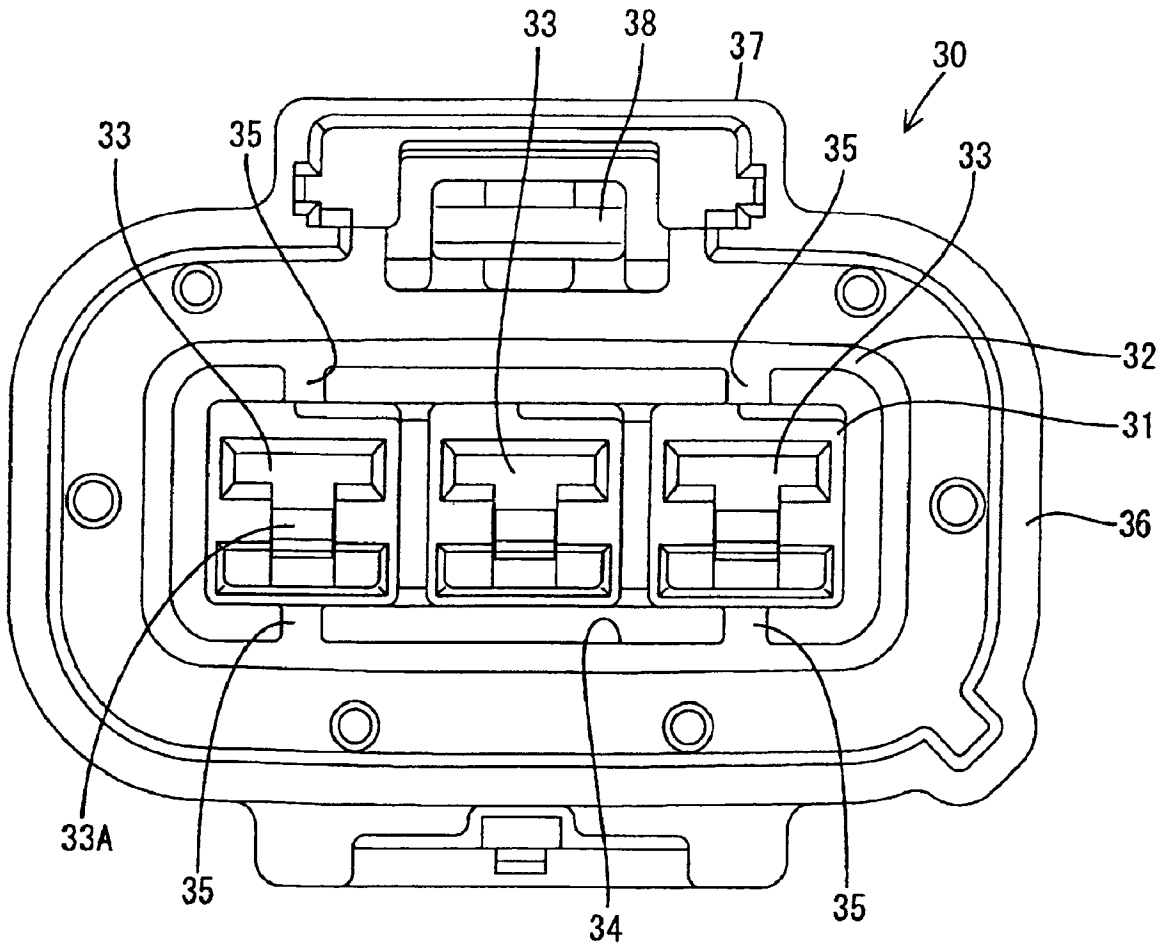
FIG. 3 is a front view of a female housing according to the invention.
Figure 11:
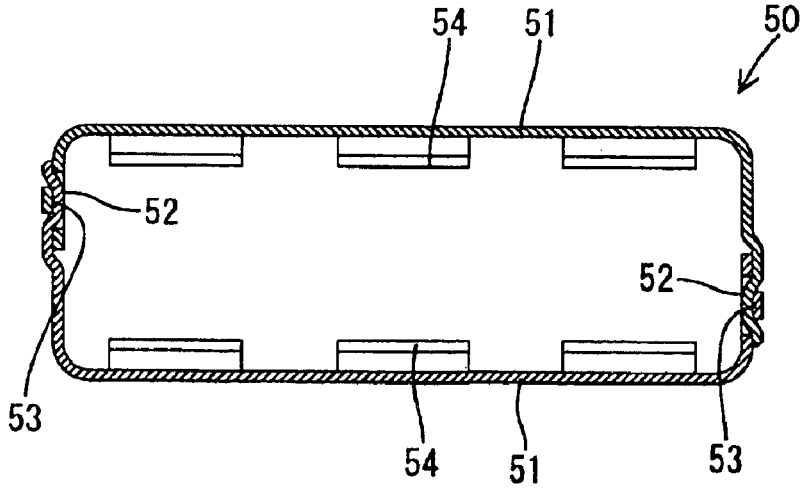
FIG. 11 is a section taken along line 11—11 in FIG. 9.
Figure 12:
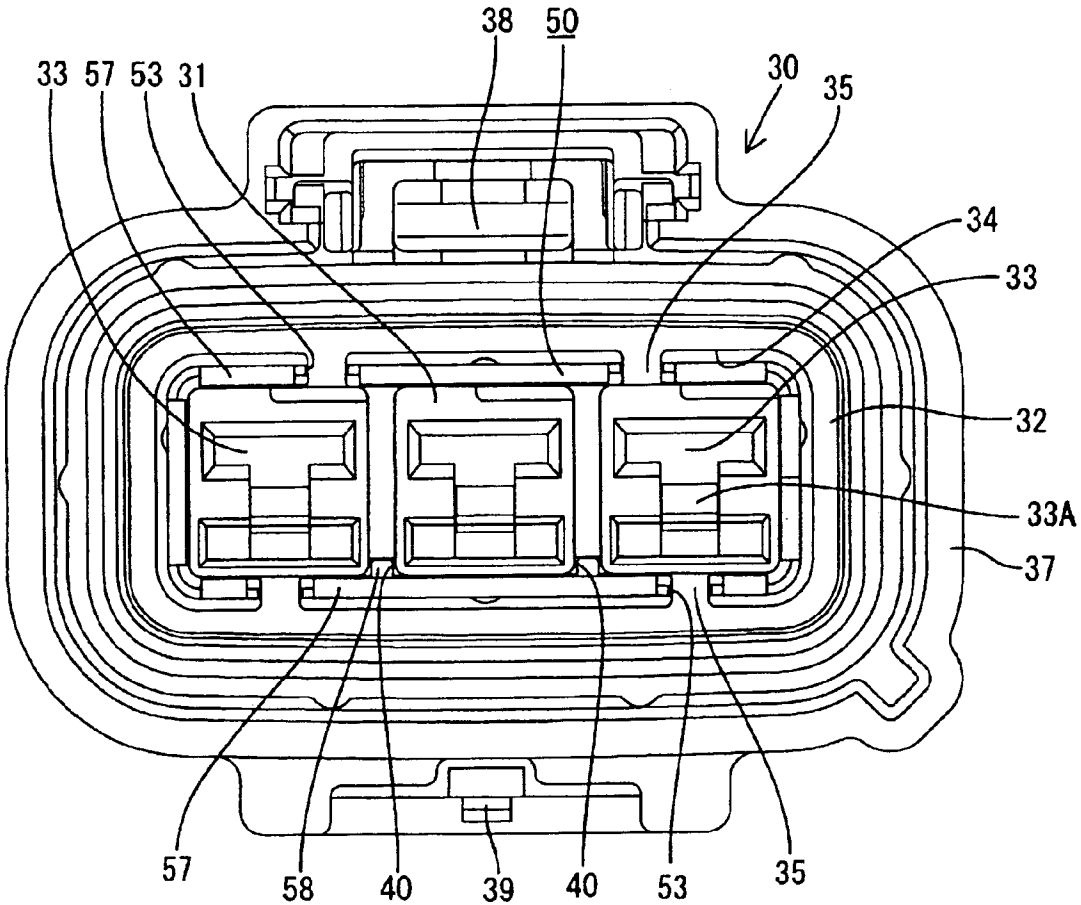
FIG. 12 is a front view showing the female housing in which the female metal shell has been mounted.

As shown in FIGS. 1–3, the female connector F has a female housing 30. Three female terminals 20 are fixed to ends of shielding electric wires 10 and are accommodated in the female housing 30, as shown in FIG. 11. A female metal shell 50 also is accommodated in the female housing 30.

The shielding electric wire 10 has a known construction. More specifically, a core wire 11, an insulating inner coating 12, a braided wire 13, and an insulating outer coating 14 are concentrically disposed on the shielding electric wire 10 and are exposed sequentially at the end thereof. The end of the braided wire 13 is folded rearward and is placed on the end of the insulating outer coating 14. The braided wire 13 then is caulked to the end of the insulating outer coating 14 with a metal pipe 15.

The female terminal 20 is formed by press working a metal plate. The female terminal 20 has a quadrangular connection portion 22 accommodating a contact piece 21 that contacts a tab 26 of a mating male terminal fitting 25. The female terminal 20 is crimped to the end of the shielding electric wire 10 by caulking a barrel 23 at the rear end of the female terminal 20 to the core wire 11 and the insulating inner coating 12.

Figure 4:
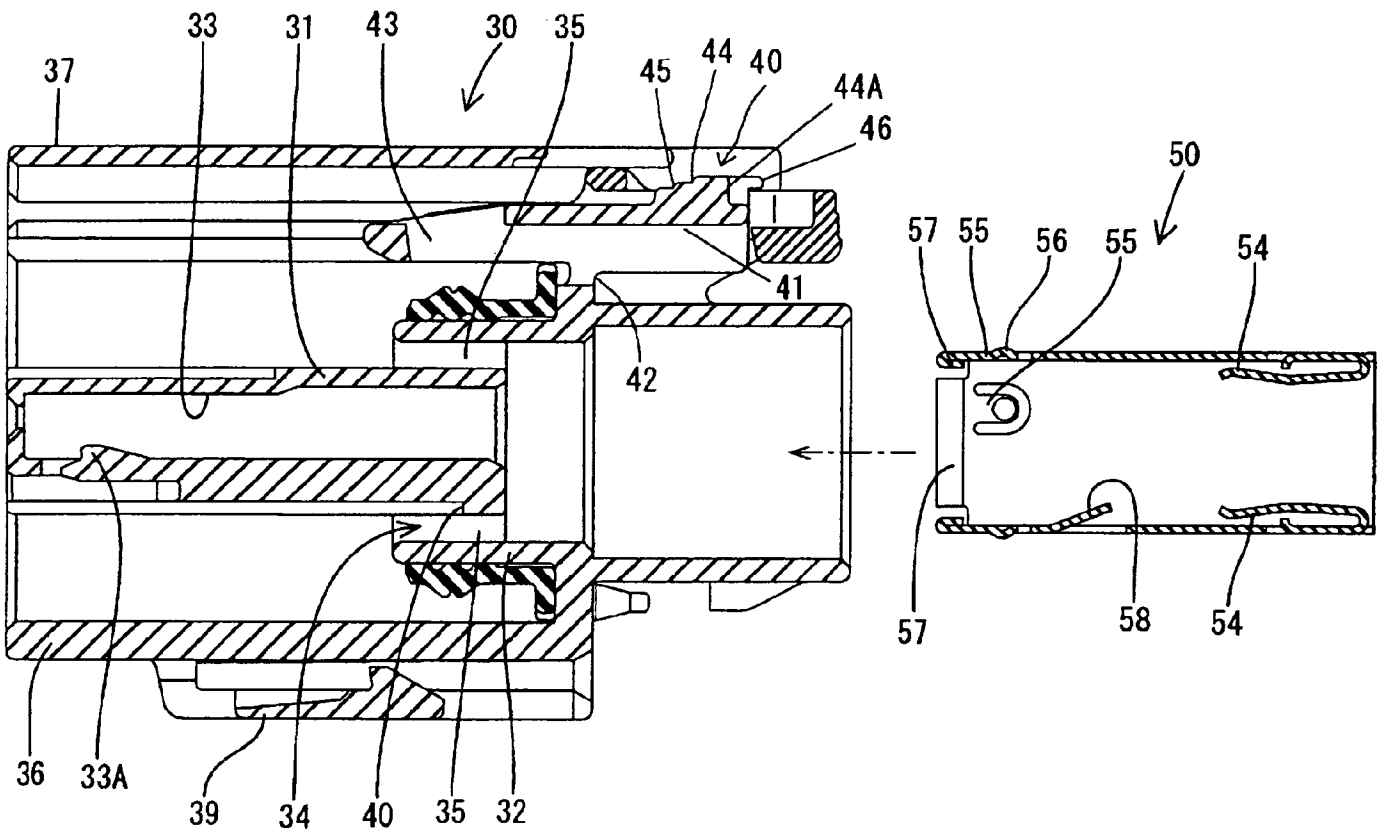
FIG. 4 is an exploded vertical sectional view of a female metal shell and the female housing.
Figure 5:
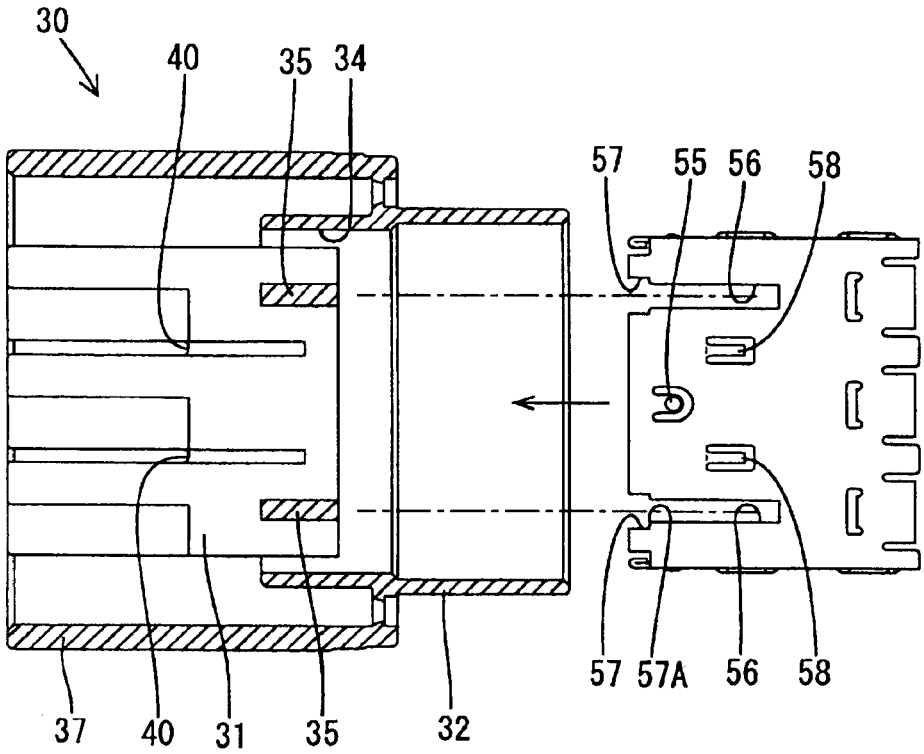
FIG. 5 is an exploded horizontal sectional view of the female metal shell and the female housing.

The female housing 30 is molded unitarily from a synthetic resin and includes an inner housing 31 and an outer housing 32, as shown in FIGS. 4 and 5. The inner housing 31 is oblong in section and three cavities 33 extend longitudinally through the inner housing 31. The cavities 33 are arranged widthwise across the inner housing 31. The female terminals 20 fixed to the ends of the shielding electric wires 10 are inserted into the cavities 33 from the rear and are locked to respective lances 33A on the bottom surface of the cavities 33. Additionally, the exposed portion at the end of the insulating inner coating 12 of the shielding electric wire 10 is prevented from slipping off the female terminals 20.

The outer housing 32 is a little larger than the inner housing 31 and is disposed rearward from the rear end of the inner housing 31. Thus, the outer housing 32 covers the periphery of the rear portion of the inner housing 31. As shown in FIG. 3, an oblong ring-shaped insertion space 34 is formed between the peripheral surface of the inner housing 31 and the inner peripheral surface of the outer housing 32 for receiving the female metal shell 50. Upper and lower ribs 35 extend in the axial direction of the female housing 30 and connect an overlapped portion of the peripheral surface of the inner housing 31 at its rear end and the inner peripheral surface of the outer housing 32 at its front end, as shown in FIGS. 4 and 5. Accordingly the inner housing 31 is suspended in the outer housing 32 by the ribs 35.

As shown in FIG. 3, the ribs 35 are at positions corresponding to the widthwise center of each of the right and left cavities 33 of the female housing 30.

A hood 36 is formed on the periphery of the outer housing 32 and extends to the front end of the inner housing 31, as shown in FIG. 4. A high dome 37 is formed at the center of an upper surface of the hood 36 of the female housing 30 and extends rearward by a predetermined length from the front end of the hood 36. A ceiling surface of a portion of the dome 37 projected from the rear end of the hood 36 is open.

A mounting portion 39 for a bracket (not shown) is formed on a lower surface of the hood 36.

A long narrow locking arm 40 is formed in the rear of the dome 37. A groove 41 is formed on a lower surface of the locking arm 40 and has a closed front end. A central portion of each of right and left side walls of the groove 41 is connected to an upper surface of the inner housing 31 through a support 42 so that the locking arm 40 can swing on the support 42 like a seesaw.

A locking hole 43 is formed at the front end of the groove 41 of the locking arm 40 and has an open upper surface. A pressing portion 44 is formed at the rear end of the locking arm 40 to deform the locking arm 40 pivotally. The pressing portion 44 faces the opening in the ceiling of the dome 37. More specifically, the pressing portion 44 is wider than the locking arm 40 and generally defines a pentagon in a plan view. The pressing portion 44 is slightly higher than the upper surface of the locking arm 40. A stepped slip prevention portion 45 is formed at the front of an upper surface of the pressing portion 44. A flange 46 is projected along the pointed rear end of the pressing portion 44. A jig insertion opening 44A is formed centrally at the rear edge of the pressing portion 44 of the locking arm 40 for receiving a jig J.

A receiving plate 47 (see FIG. 26) projects from right and left surfaces of the rear end of the locking arm 40.

Figure 6:
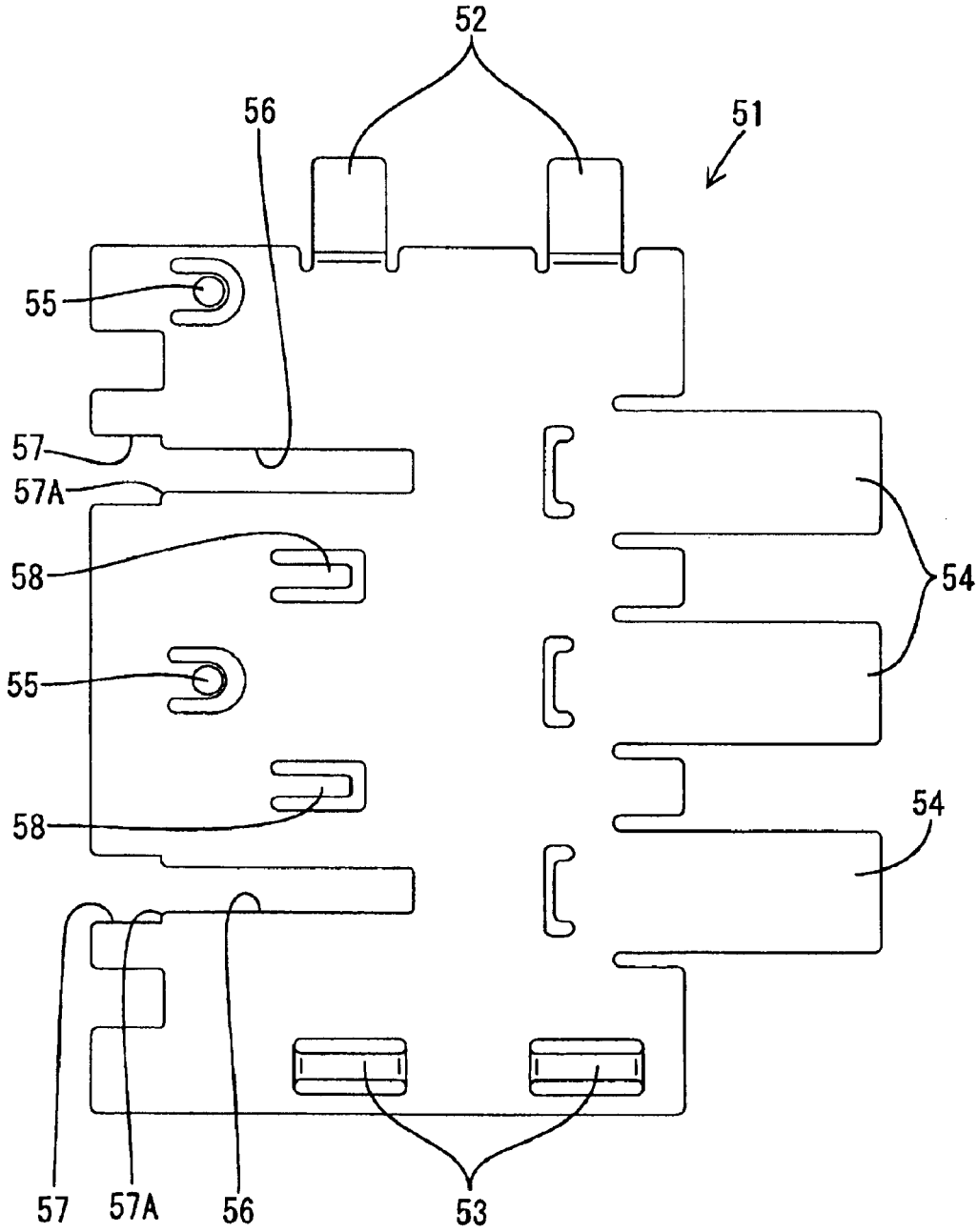
FIG. 6 is a plan view of the metal blank for forming one part of the split female metal shell.

The female metal shell 50 is shown in FIGS. 6-11 and is composed of two split shells 51, each of which is formed by bending the metal blank shown in FIG. 6. Each split shell 51 is a shallow channel, as shown most clearly in FIG. 7.

Front and rear insertion pieces 52 project from one of the side plates, whereas front and rear receiving portions 53 are formed at the other of the side plates. The two split shells 51 are opposed to each other symmetrically with respect to a point. Then, as shown in FIGS. 8–11, the insertion piece 52 is inserted into the corresponding receiving portion 53 and caulked to form the quadrangular female metal shell 50.

Three contact pieces 54 are folded in at the rear edge of each of upper and lower surfaces of the female metal shell 50, and are configured to contact the metal pipe 15 fit on the end of the braided wire 13 of each shielding electric wire 10. Thus, the metal pipe 15 is sandwiched between the upper and lower contact pieces 54 arranged in the right-to-left direction. A contact plate 55 is raised rearward from the front end of each of the upper, lower, right and left surfaces of the female metal shell 50 for contacting a mating metal shell 80. A contact projection 55A is projected from the outer surface of each contact plate 55.

Figure 7:
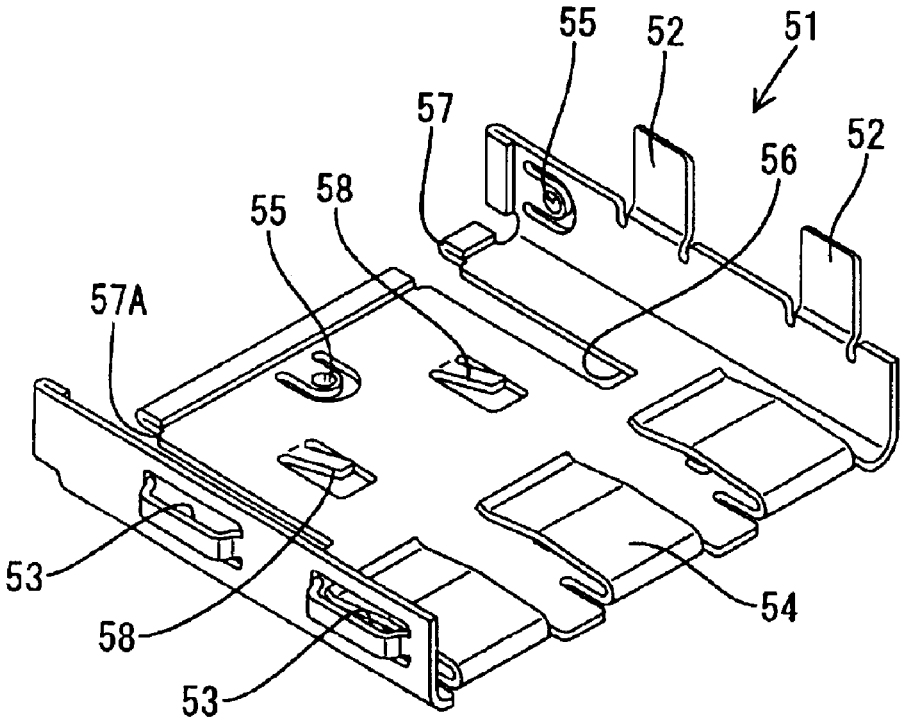
FIG. 7 is a perspective view of the completed part of female metal shell formed from the blank in FIG. 4.
Figure 8:
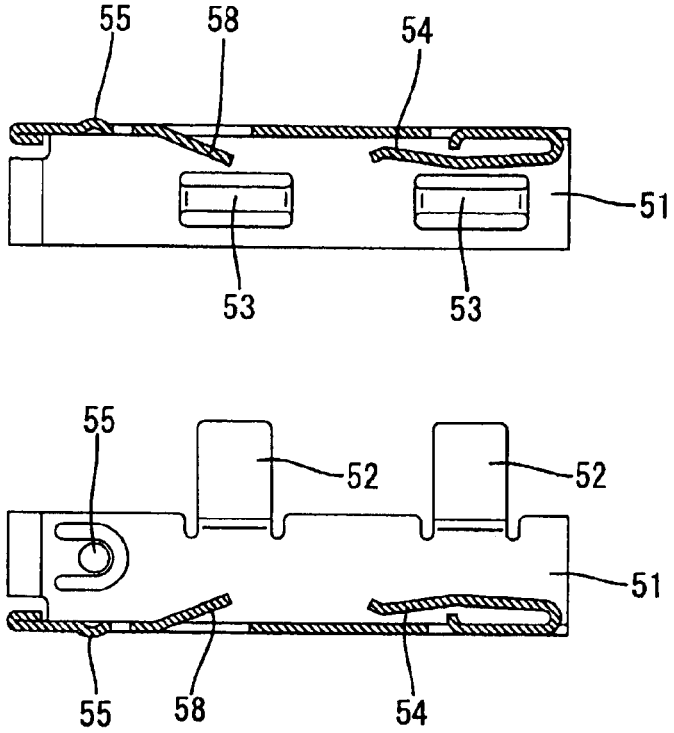
FIG. 8 is an exploded vertical sectional view of the two halves of the female metal shell.
Figure 9:
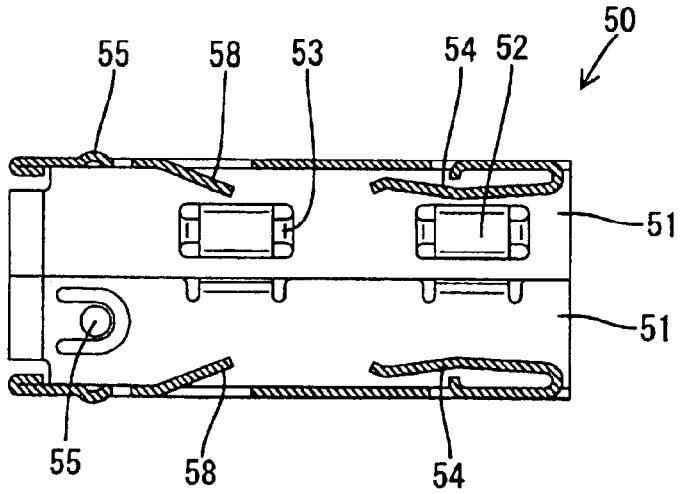
FIG. 9 is a vertical sectional view of the completed female metal shell.
Figure 10:
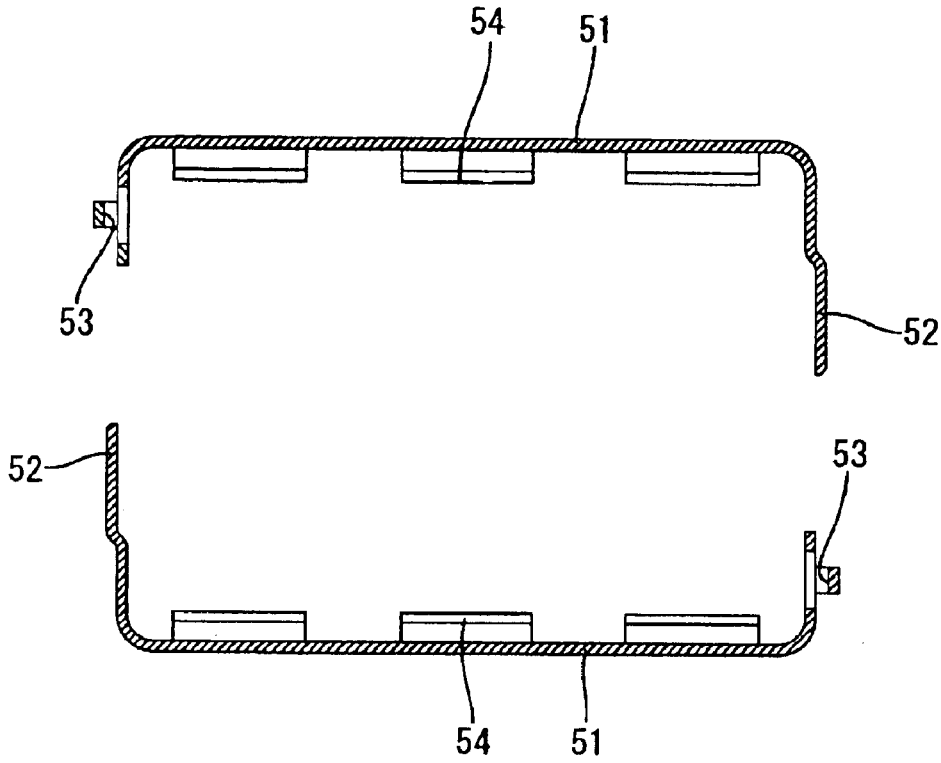
FIG. 10 is a section taken along line 10—10 in FIG. 8.

As shown in FIGS. 6 and 7, two slits 56 are formed on each of the upper and lower surfaces of the female metal shell 50 for receiving the ribs 35. As explained above, the ribs 35 suspend the inner housing 31 inside the outer housing 32 of the female housing 30. Each slit 56 is formed by cutting the female metal shell 50 from the front end of each of the upper and lower surfaces thereof to approximately the center thereof in a front-to-back direction. The width of each slit 56 is so set that the rib 35 is inserted tightly therein. A guide 56A is formed at the entrance of the slit 56 and is wider than the remainder of the slit 56. The guide 56A has a rounded step 56B rearward from the entrance of the slit 56.

The front end of each surface of the female metal shell 50 is folded in by a predetermined length, with the front end in close contact with the lower surface of the female metal shell 50 to form a folded portion 57.

Figure 13:
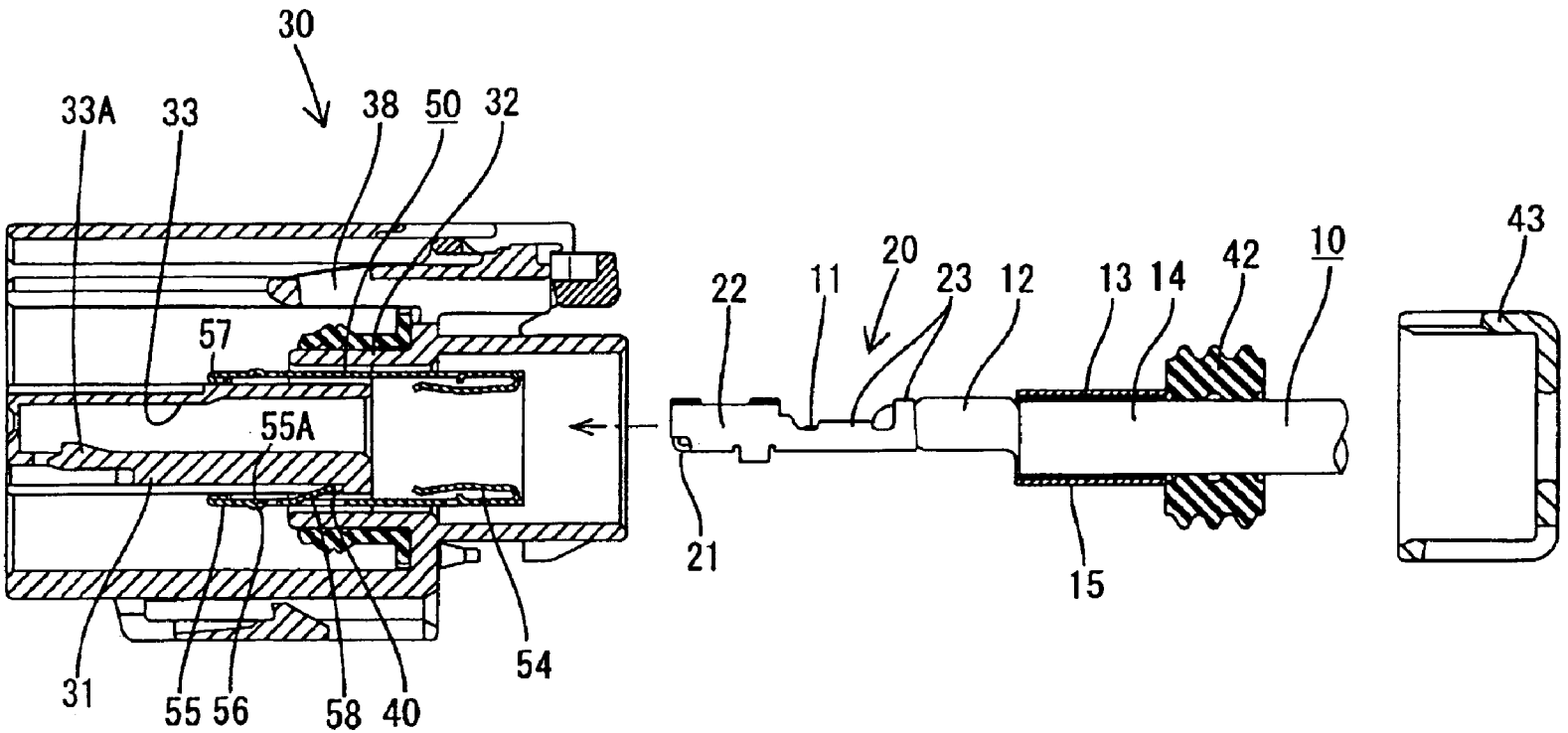
FIG. 13 is an exploded sectional view of the female connector.

The female metal shell 50 can be fitted on the periphery of the inner housing 31. The female metal shell 50 extends from approximately the center of the inner housing 31 in its longitudinal direction to a position a little rearward from the center of the outer housing 32 in its longitudinal direction, as shown in FIG. 13. When the female metal shell 50 is fit on the periphery of the inner housing 31, the folded portion 57 contacts the peripheral surface of the inner housing 31 to from a flexing space 57A that permits the contact plate 55 to deform elastically inward.

Locking claws 58 are raised rearward at positions inward from the slits 56 on the upper and lower surfaces of the female metal shell 50. A locking groove 48 is formed on the upper and lower surfaces of the inner housing 31 at a position corresponding to the locking claws 58 for locked engagement with the locking claws 58.

The male connector M has a male housing 60, as-shown in FIGS. 1, 2, 14 and 16–21. Three male terminals 25 are fixed to ends of the shielding electric wires 10 and are accommodated in the male housing 60. A male metal shell 80 also is accommodated in the male housing 60.

Each male terminal 25 is formed by press working a metal plate. More particularly, each male terminal 25 has a front end formed into a tab 26 and a rear end formed into a barrel 27. The barrel 27 is crimped or caulked to the core wire 11 and the insulating inner coating 12 at the end of the shielding electric wire 10.

The male housing 60 is molded unitarily from a synthetic resin and has an inner housing 61 and an outer housing 62. The inner housing 61 is oblong in section. Three cavities 63 are arranged widthwise in the inner housing 61, and a fit-in concavity 65 is formed in the front end of the inner housing 61 of the male housing 60 for receiving the front end of the inner housing 31 of the female housing 30. The male terminals 25 fixed to the ends of the shielding electric wires 10 are inserted into the cavities 63 from the rear and are locked to lances 66 formed on the bottom surface of the cavities 63 respectively. Thus, the male terminals 25 are prevented from slipping out of the cavities 63, and the tabs 26 of the male terminals 25 project into the fit-in concavity 65.

The outer housing 62 is a little larger and longer than the inner housing 61 and is disposed forward from the rear end of the inner housing 61. Thus, the outer housing 62 covers the periphery of front and rear portions of the inner housing 61. A small hood 66 of the outer housing 62 can be fit in the hood 37 of the female housing 30.

Figure 14:
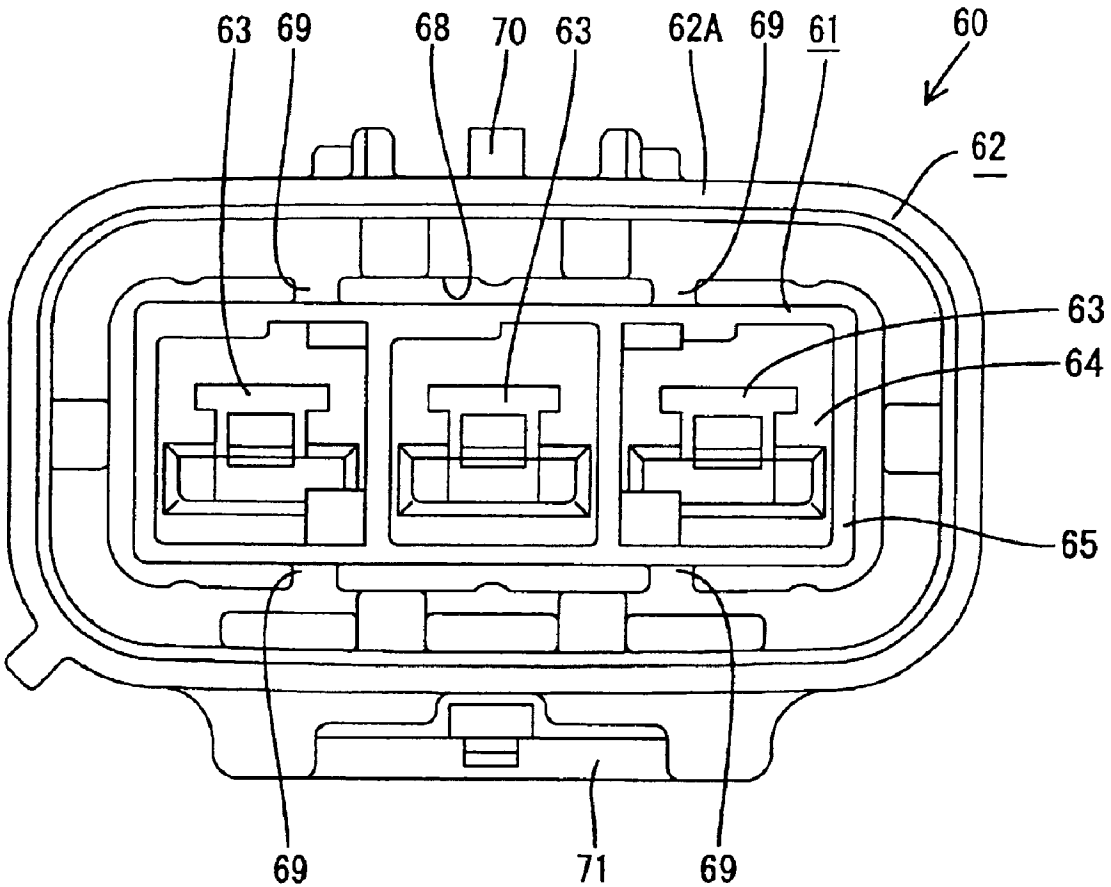
FIG. 14 is a front view showing a male housing.

An oblong ring-shaped insertion space 68 is formed between the peripheral surface of the inner housing 61 and the inner peripheral surface of the outer housing 62, as shown in FIG. 14, for receiving the male metal shell 80. Upper and lower axially extending ribs 69 extend through the space 68 to connect the longitudinal center of peripheral surface of the inner housing 61 and the inner peripheral surface of the outer housing 62 at a rear position of the small hood 66 thereof. Accordingly the inner housing 61 is suspended in the outer housing 62 by the ribs 69.

The ribs 69 are over and under the right and left cavities 33, and the lower ribs 69 are a little closer to the central cavity 63, as shown in FIG. 14.

Figure 29:
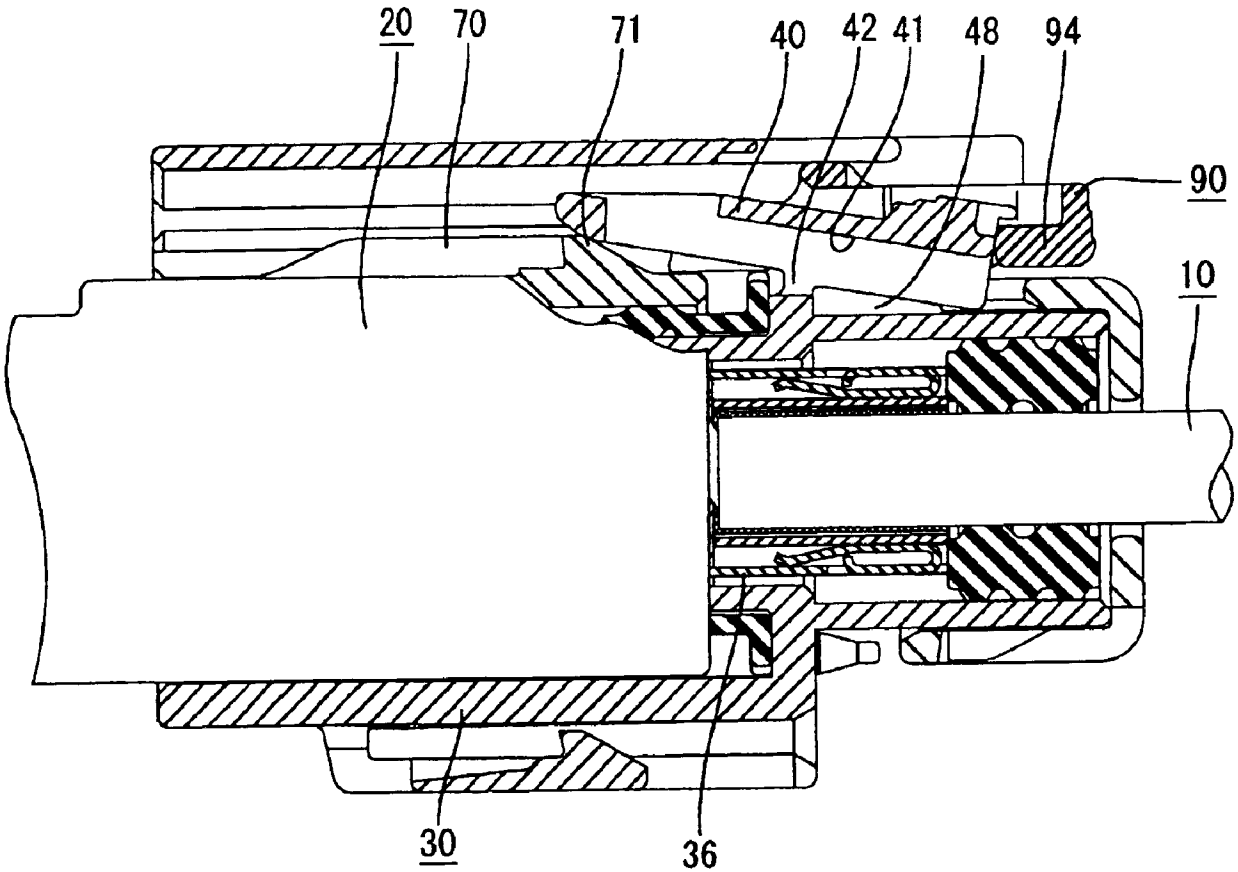
FIG. 29 is a partial vertical sectional view showing a state in which female and male housings are being fitted on each other.

A locking projection 70 is disposed at a front end of an upper portion of the peripheral surface of the outer housing 62. Right and left guide walls 71 are formed on the upper surface of the outer housing 62 to guide the locking arm 38 therebetween. The locking projection 70 is formed between the right and left guide walls 71 and close to the line connecting the front ends of the right and left guide walls 71. The locking projection 70 can fit in the locking hole 43 of the locking arm 40. More particularly, the front side of the locking arm 40 rides across the locking projection 70 as the female and male housings 30 and 60 are fit together. Additionally, the rear of the locking arm 40 pivotally deforms and projects into a flexing space 48, as shown in FIG. 29. The locking arm 40 returns elastically to its original state when the female and male housings 30 and 20 have been fit together normally. Thus the locking projection 70 can fit in the locking hole 43 (see FIG. 31).

A mounting portion 72 for a bracket (not shown) is formed on a lower peripheral surface of the outer housing 62.

Figure 16:
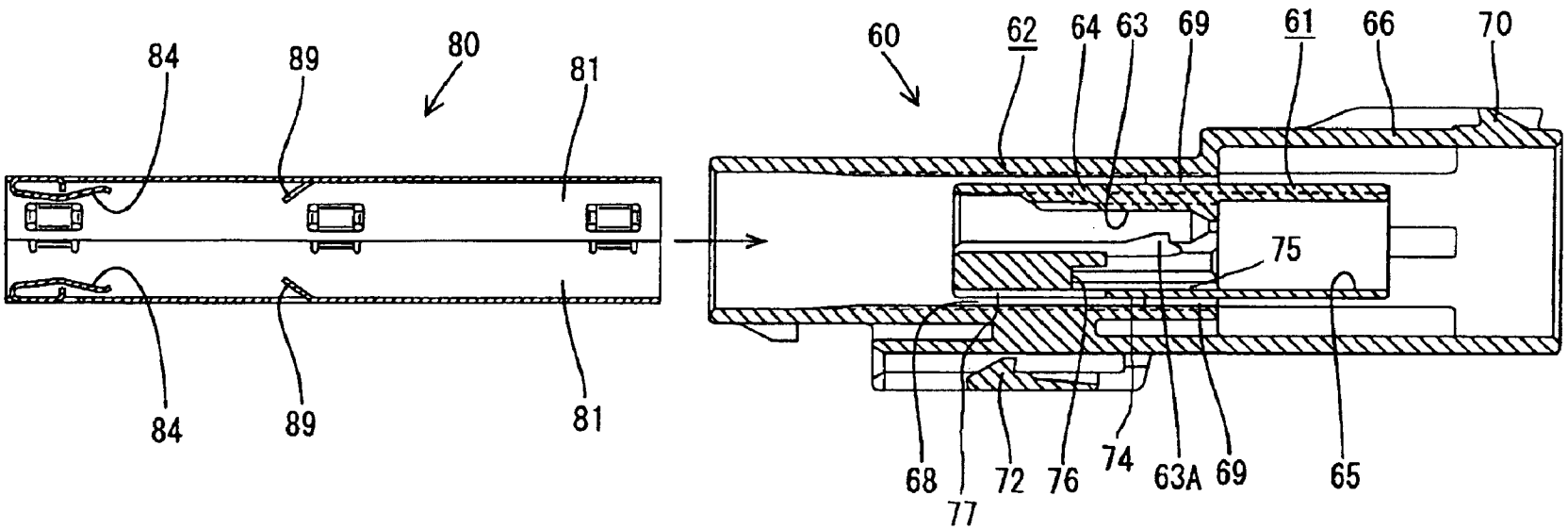
FIG. 16 is an exploded sectional view of a male metal shell and the male housing.
Figure 17:
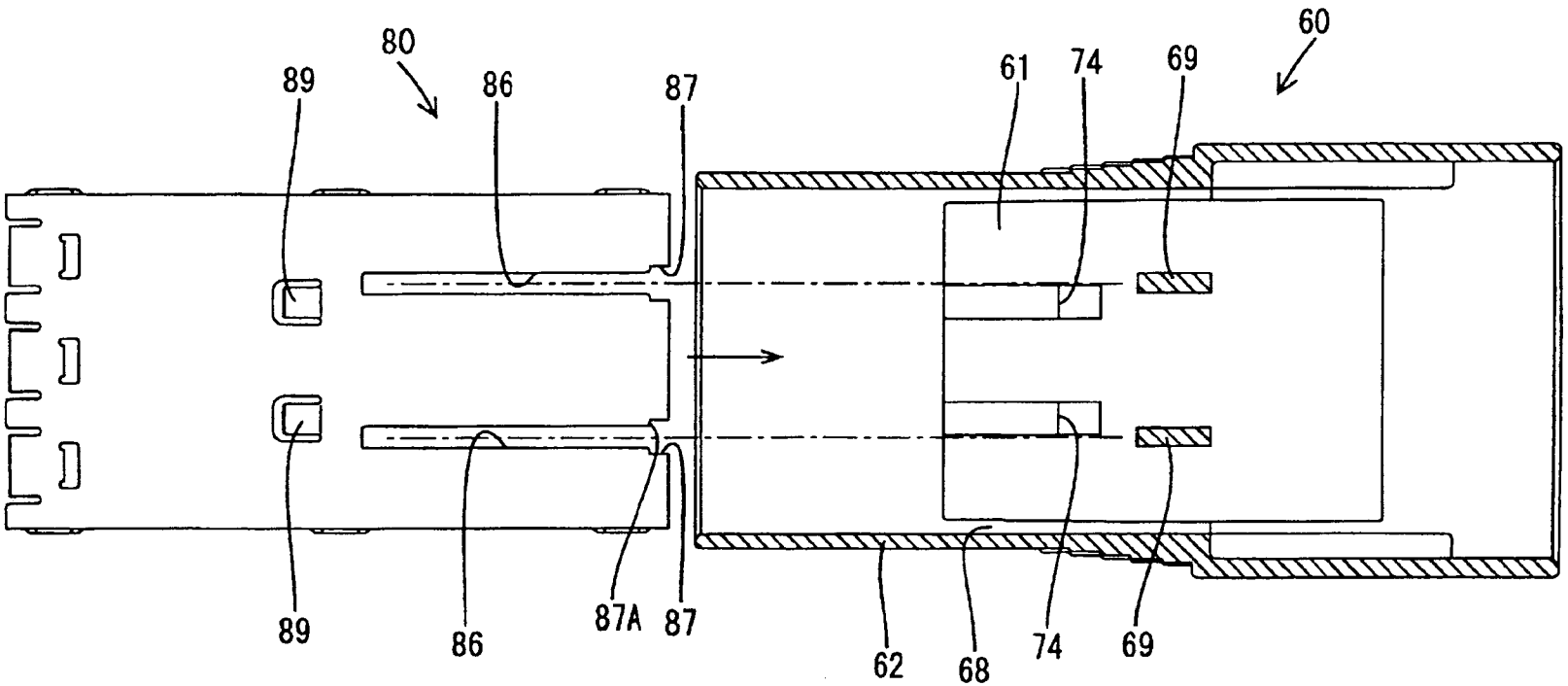
FIG. 17 is a cross sectional view taken along line 17—17 in FIG. 16.

As shown in FIG. 16, a hole 75 reaching the vicinity of the base of the lance 63A is formed on a bottom wall 74 of a flexing space 73 of the lance 63A in the right and left cavities 63, with the position of the hole 75 located a little toward the central cavity 63. The inner portion of the hole 75 is opened on the lower surface of the inner housing 61 to form a locking hole 76.

An escape groove 77 is formed on the lower surface of the inner housing 61 at a position rearward from the locking hole 76 to reduce the elastic deformation of the locking claw 85.

Figure 20:
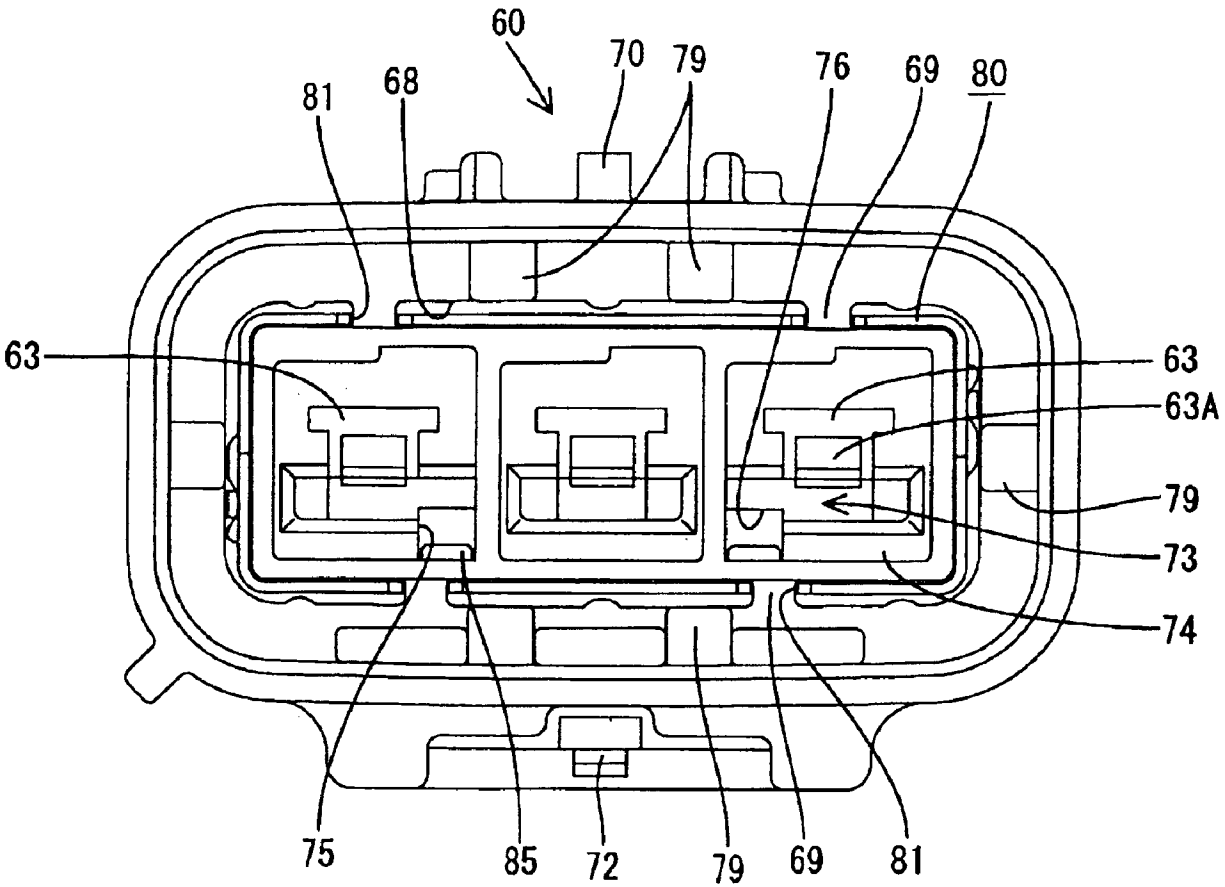
FIG. 20 is a front view showing the male housing in which the male metal shell has been mounted.

Six opening prevention ribs 79 are formed on the inner surface of the small hood 66. As shown in FIG. 20, the opening prevention ribs 79 are formed longitudinally in the region where the male metal shell 80 is projected into the small hood 66. As shown in FIG. 20, two opening prevention ribs 79 are formed on each of upper and lower inner peripheral surfaces of the small hood 66. One of the two opening prevention ribs 79 is disposed between the left and intermediate cavities 63 and the other is disposed between the right and intermediate cavities 63. One opening prevention rib 79 is formed at a position intermediate in the height of the male housing 60 on each of the right and left inner peripheral surfaces of the small hood 66.

Figure 18:
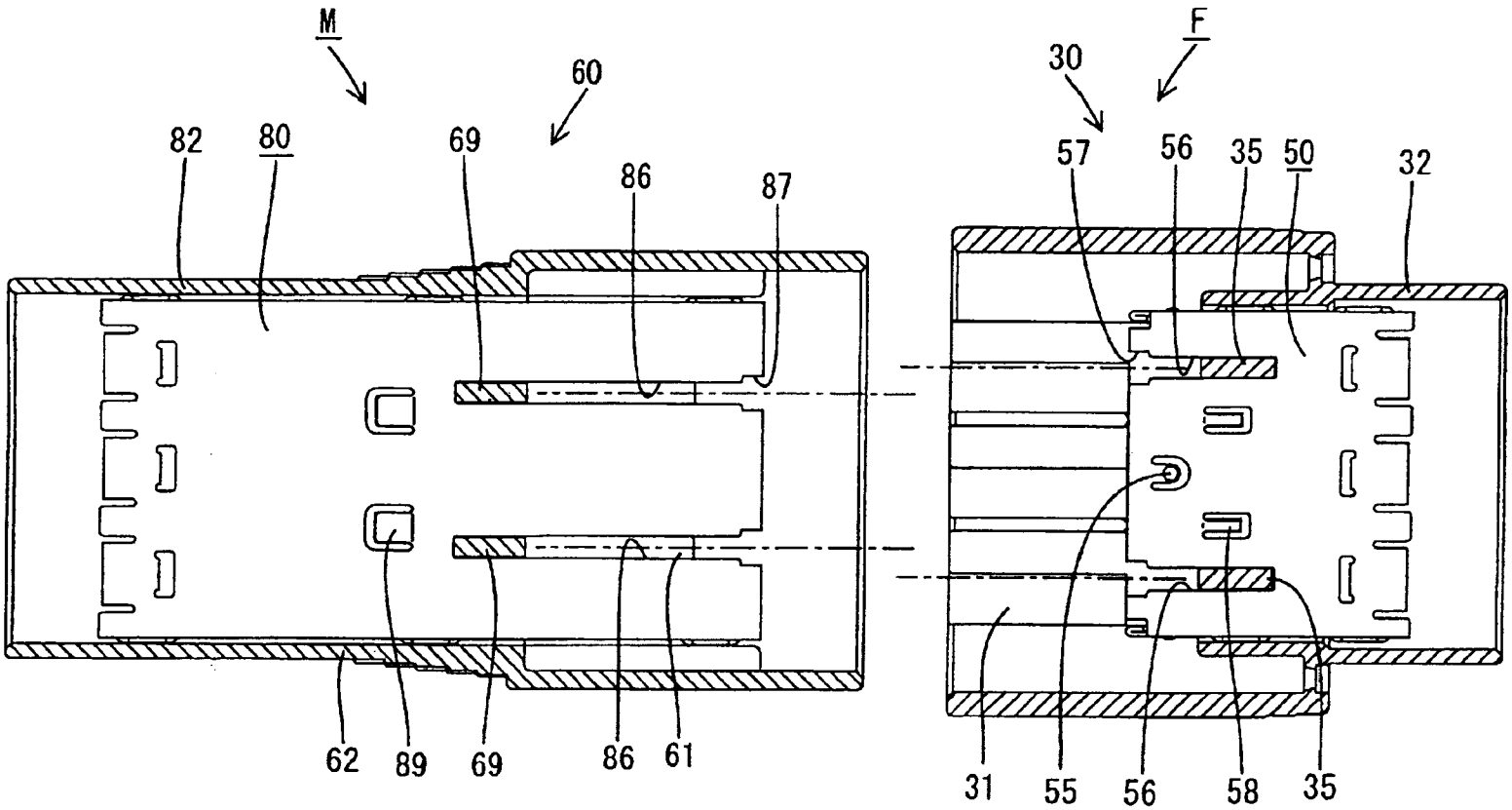
FIG. 18 is an exploded cross-sectional view of the female and male housings with the shells mounted therein.
Figure 19:
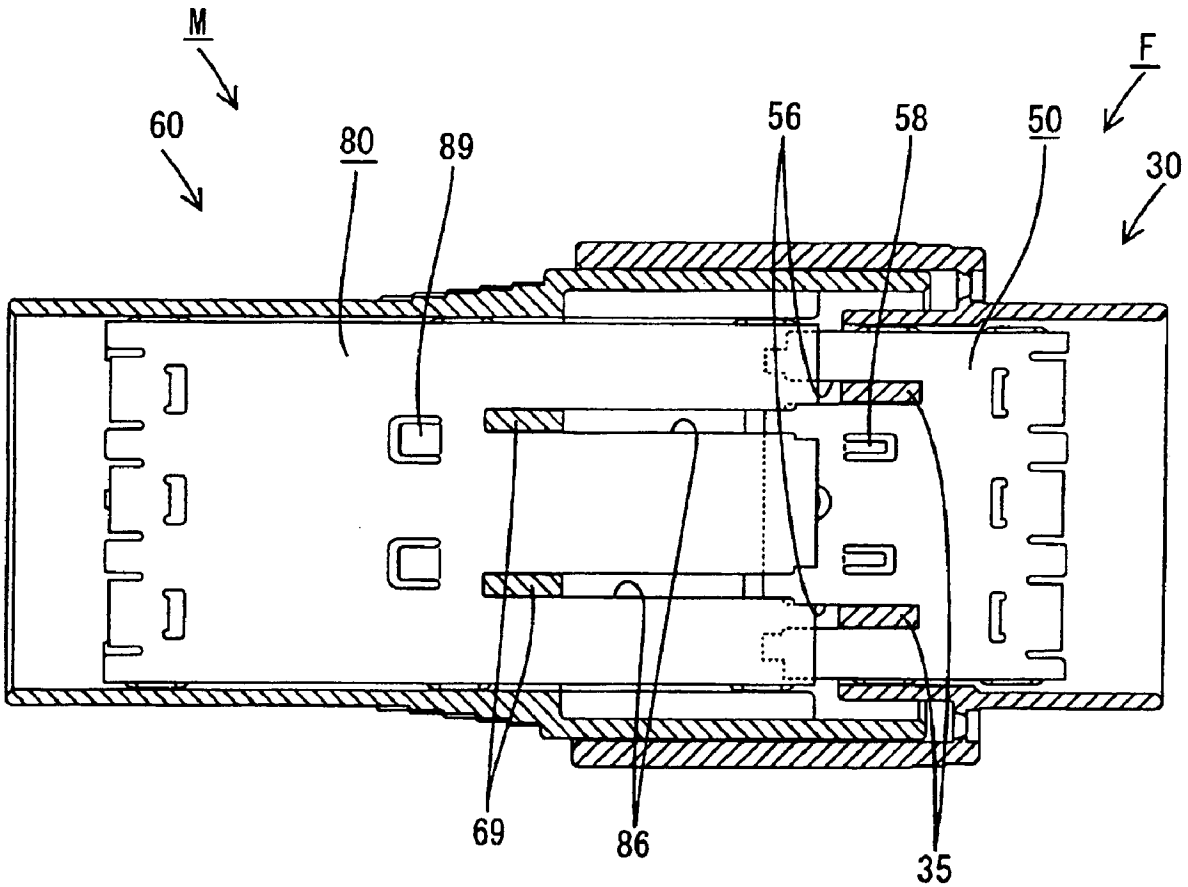
FIG. 19 is a sectional view of the connected female and male housings and shells.
Figure 21:
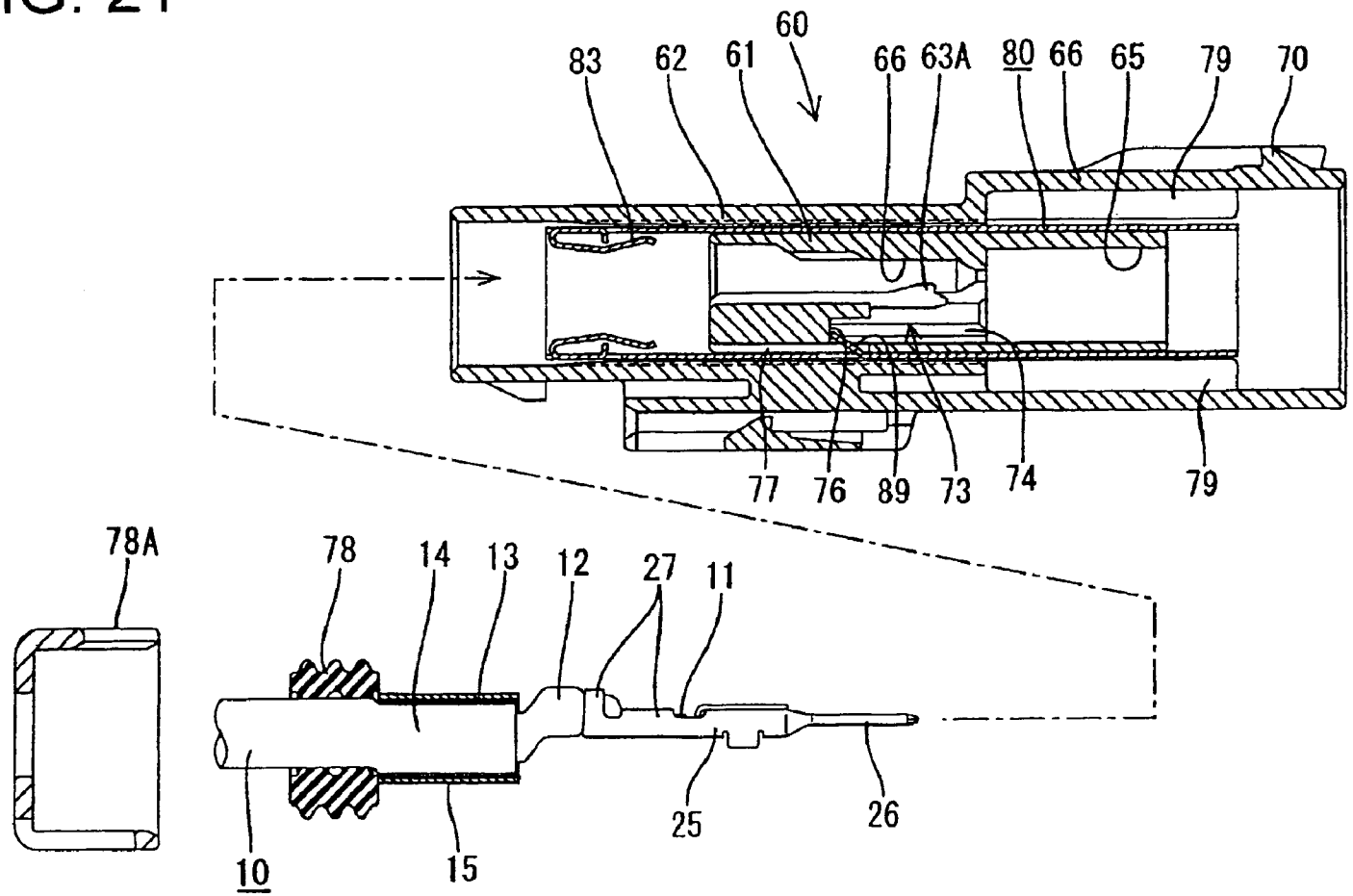
FIG. 21 is an exploded sectional view of the male connector.
Figure 22:
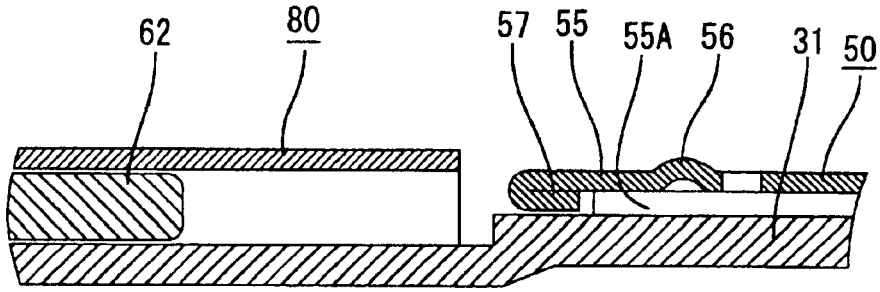
FIG. 22 is a partial sectional view showing a state before the male and female metal shells are connected to each other.
Figure 23:
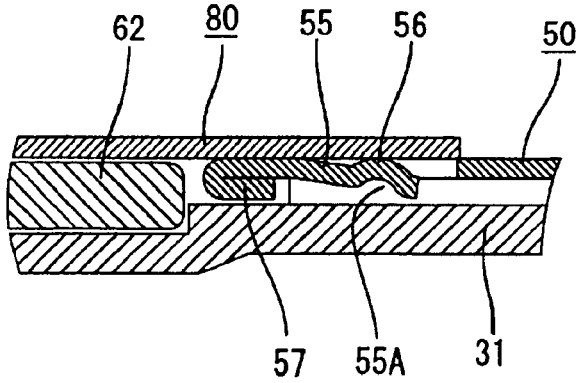
FIG. 23 is a partial sectional view showing a state in which the male and female metal shells have been connected to each other.
Figure 24:
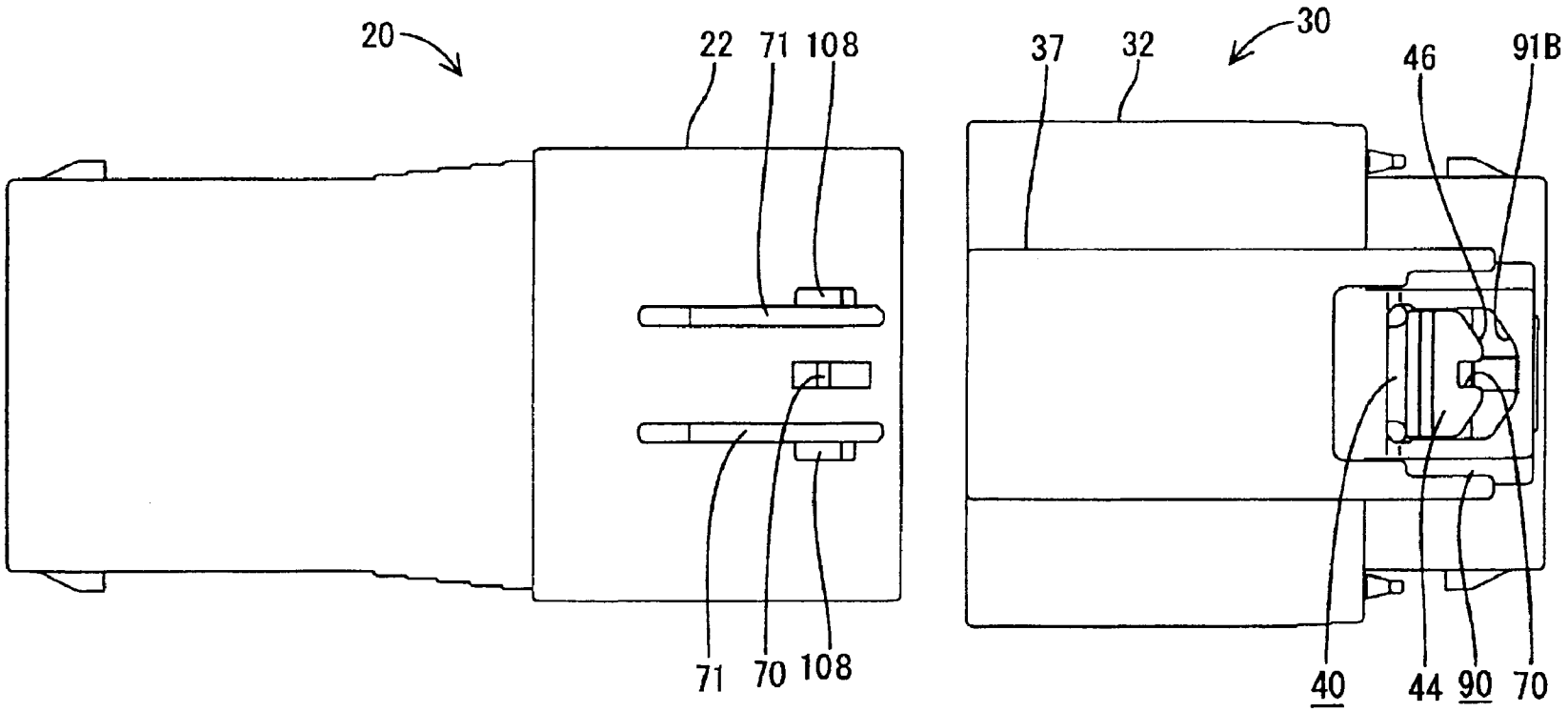
FIG. 24 is an exploded plan view of female and male connectors.

The male metal shell 80 is quadrangular, as shown in FIGS. 15–18, and is configured to fit on the periphery of the female metal shell 50, as shown in FIG. 19. Additionally, the male metal shell 80 has a length to project forward and rearward from the inner housing 61, as shown in FIG. 21. Thus, a portion of the male metal shell 80 projected from the front end of the inner housing 61 can be fit on the front end of the female metal shell 50, as shown in FIG. 19.

The male metal shell 80 is constructed of two split shells 81 of the same configuration and connected to each other. The construction for connecting the split shells 81 to each other is similar to construction for connecting the split shells 51 of the female metal shell 50.

Three contact pieces 84 are folded in at the rear edge of each of upper and lower surfaces of the male metal shell 80 and contact the metal pipe 15 fit on the periphery of the braided wire 13 of each shielding electric wire 10. Thus, the metal pipe 15 is sandwiched between the upper and lower contact pieces 84 arranged in the right-to-left direction.

Figure 15:
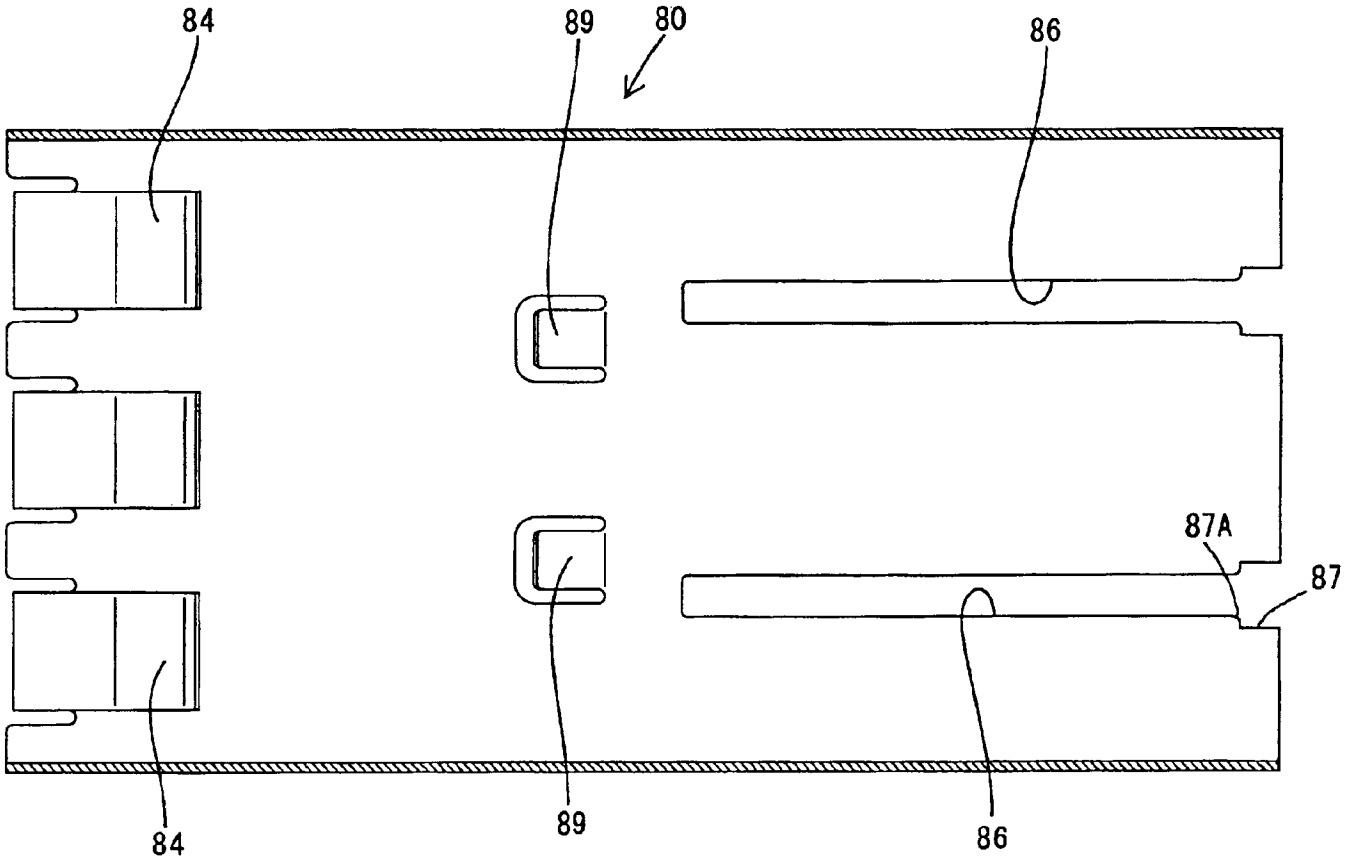
FIG. 15 is a horizontal sectional view of the male metal shell.

As shown in FIG. 15, two slits 86 are formed on each of upper and lower surfaces of the male metal shell 80 for receiving the ribs 69. Each slit 86 is formed by cutting the male metal shell 80 from the front end of each of the upper and lower surfaces thereof to approximately the center in the front-to-back direction. The width of the slit 86 is set so that the rib 69 is inserted tightly therein.

With reference to FIG. 18, the slits 86 of the male metal shell 80 are disposed widthwise inward to prevent them from aligning with the slits 56 of the female metal shell 50.

A guide 87 that is wider than the slit 86 is formed at the entrance of the slit 86. The guide 87 has a rounded step 87A disposed rearward from the entrance of the slit 86.

As shown in FIGS. 15–19, two locking claws 89 are formed at positions rearward from the slits 86 and a little inward from the slits 86 on each of the upper and lower surfaces of the male metal shell 80. Each locking claw 89 is raised to extend rearward and inward from the respective surface of the male metal shell 80, as shown in FIG. 16. Locking holes 76 are formed on the upper and lower surfaces of the inner housing 61 at positions corresponding to the locking claws 89 for engaging the locking claws 89.

Figure 28:
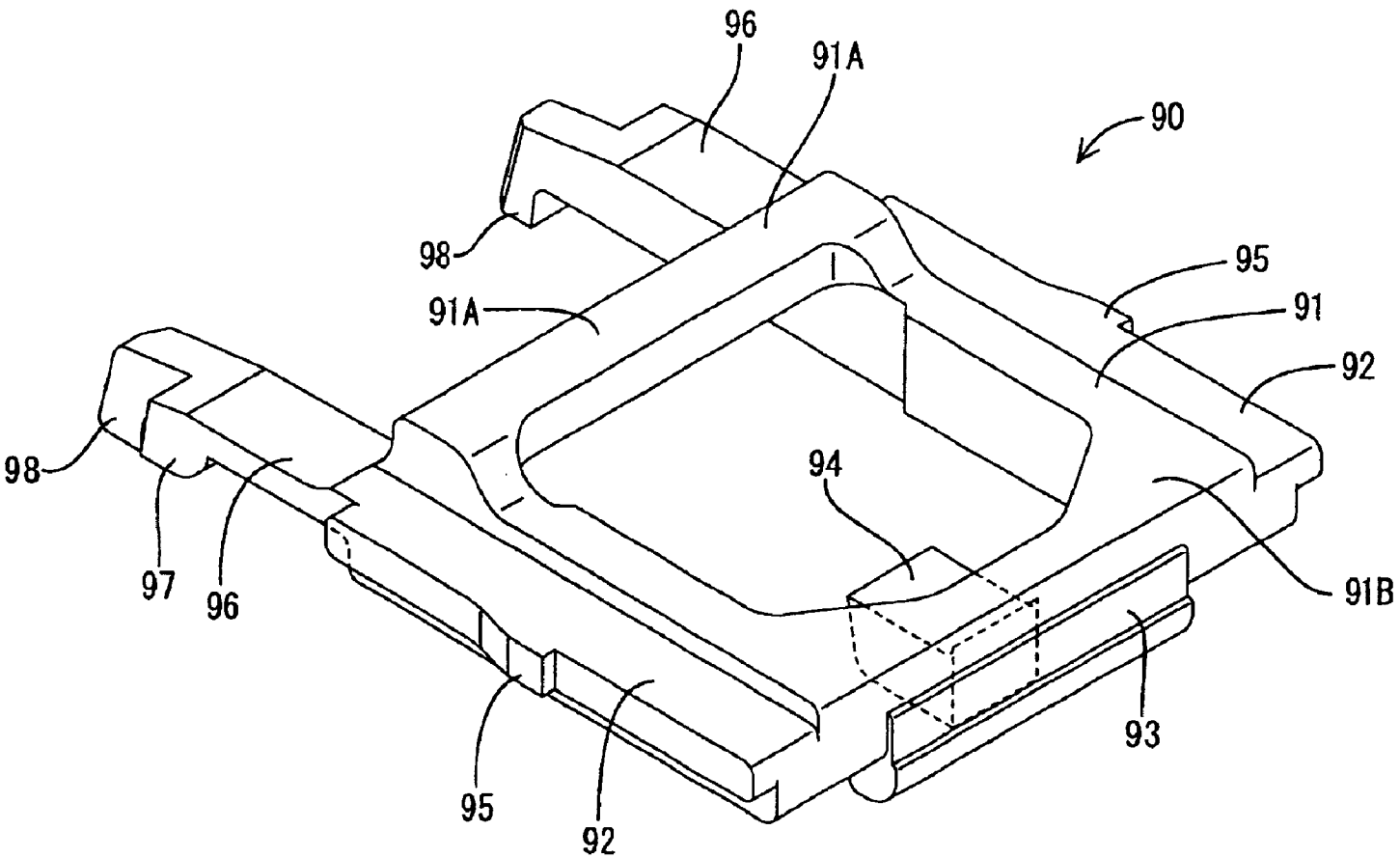
FIG. 28 is a perspective view showing the detector.

A detector 90 is installed inside the rear of the dome 37 of the female housing 30. The detector 90 is made of synthetic resin and is formed separately from the female housing 30. As shown in FIG. 28, a rectangular frame-shaped body 91 of the detector 90 is disposed between the right and left side-walls of the dome 37. A front frame 91A of the body 91 is formed higher than other portions thereof. An edge of the inner side of a rear frame 91B of the body 91 of the detector 90 opens to the jig insertion opening 44A.

Figure 25:
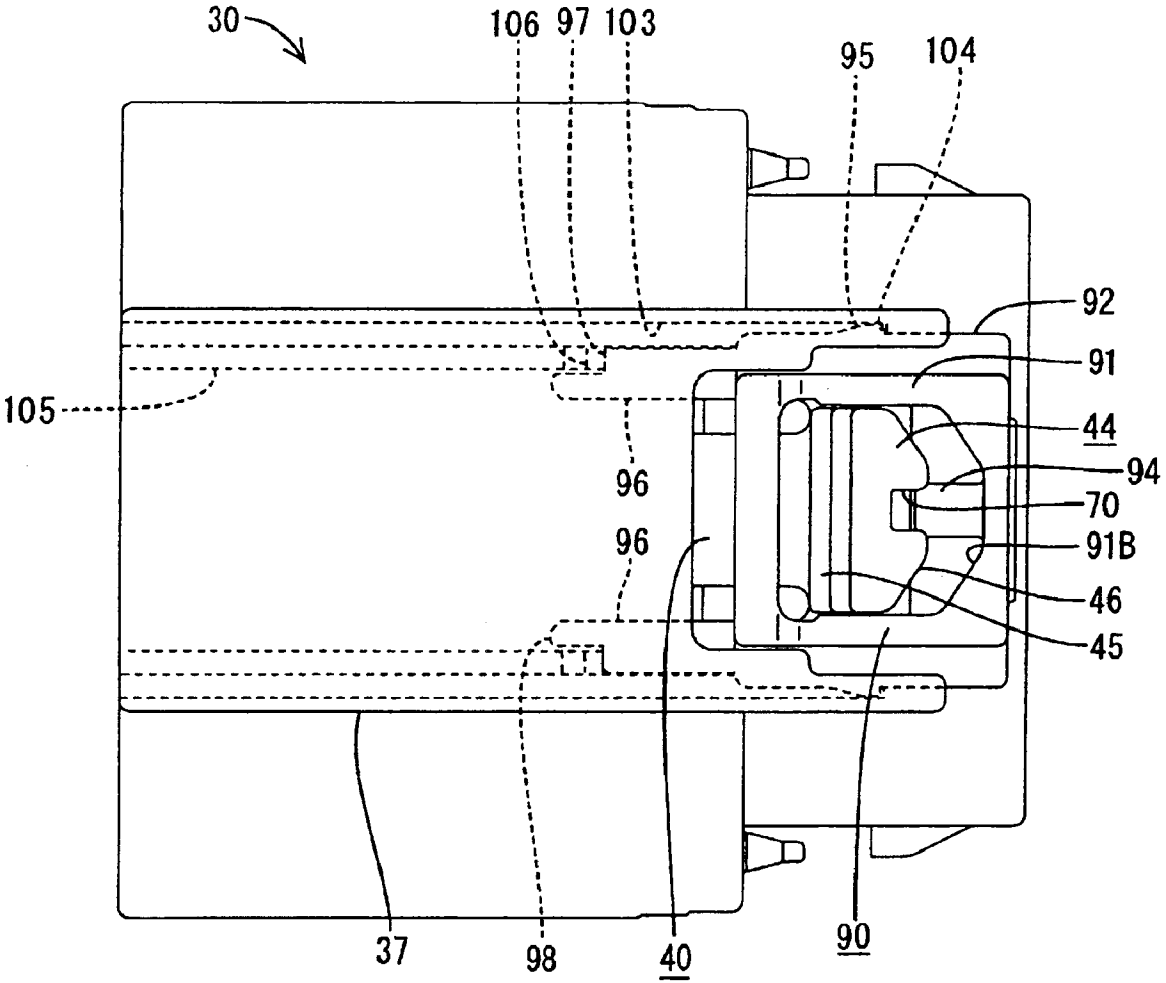
FIG. 25 is a plan view showing the female housing in which a detector is mounted on a wait position.
Figure 26:
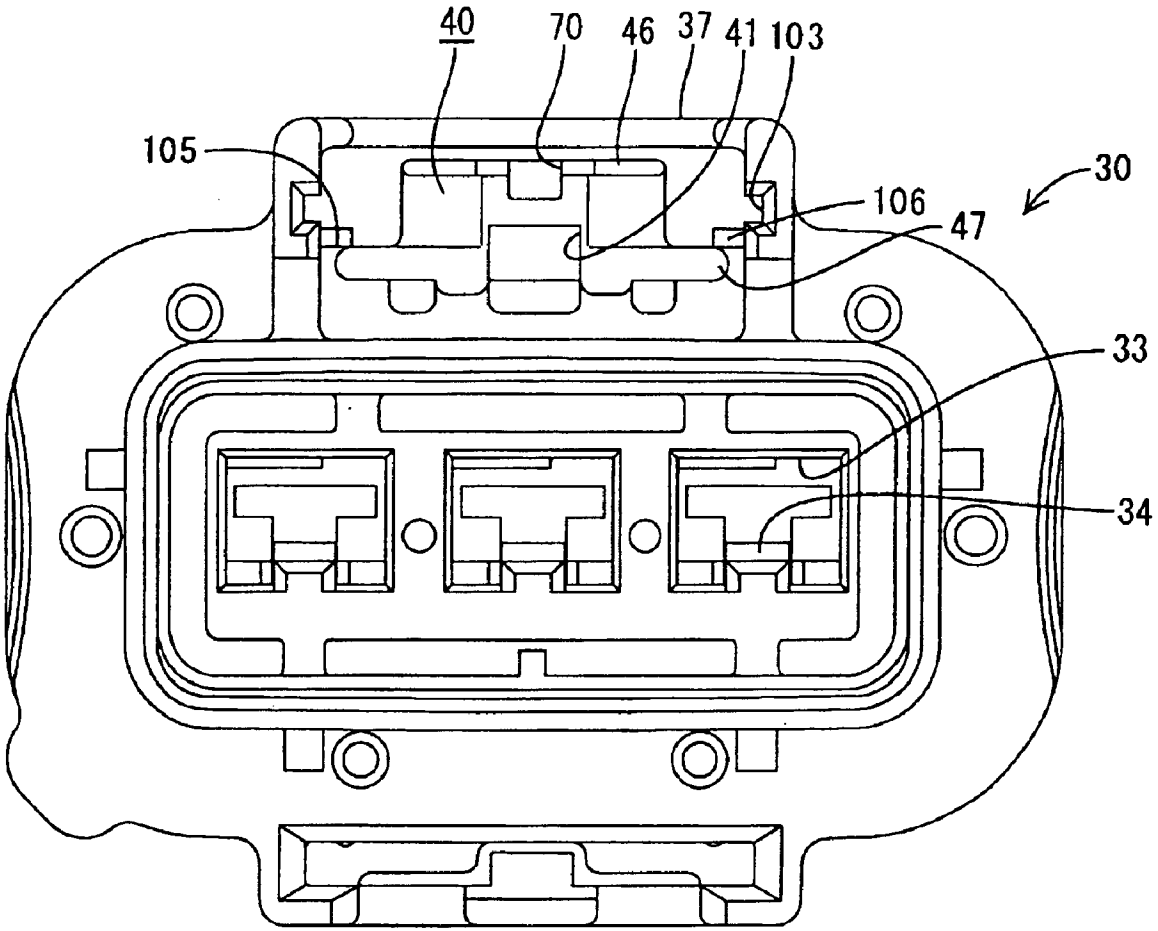
FIG. 26 is a rear view showing the female housing.

A sliding plate 92 projects from the right and left outer side surfaces of the body 91. A longitudinal guide groove 41 is formed on the inner surface of the right and left side-walls of the dome 37 for slidably receiving the sliding plate 92. As shown in FIG. 25, the sliding plate 92 fits in the guide groove 41, and the pressing portion 44 of the locking arm 40 fits in the body 91 to move the sliding plate 92 longitudinally under the guide of the guide groove 41. A stepped slide prevention portion 93 is formed on a rear surface of the body 91.

Figure 31:
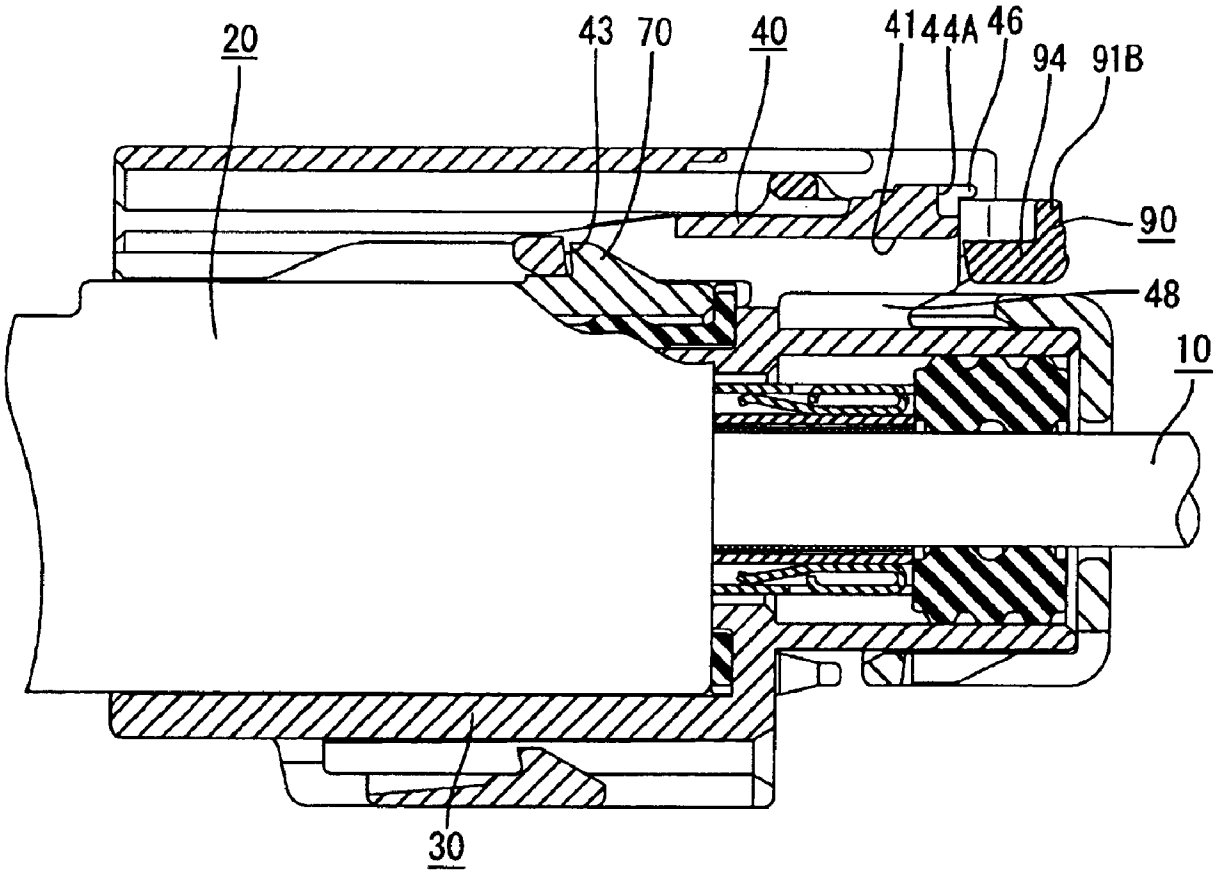
FIG. 31 is a partial vertical sectional view showing a state in which the female and male housings have been fit together.

An upper surface of a rear frame 91B of the body 91 is lower than the flange 46 that projects from the rear end of the pressing portion 44 of the locking arm 40 when the locking arm 40 is in a natural state and when the detector 90 is inside the rear of the dome 37 of the female housing 30, as shown in FIG. 31. As shown in FIG. 25, an inner surface of the rear frame 91B is concave and corresponds to the configuration of the flange 46 of the pressing portion 44. A detection projection 94 is formed at the lower end of the widthwise center of the inner surface of the rear frame 91B. The detection projection 94 can enter the groove 41 on the lower surface of the locking arm 40, when the locking arm 40 is in a natural state.

A projection 95 is formed at approximately the longitudinal center of the sliding plate 92 of the detector 90. A locking step 104 is formed at the entrance of the guide groove 103 and can lock the projection 95.

Figure 30:
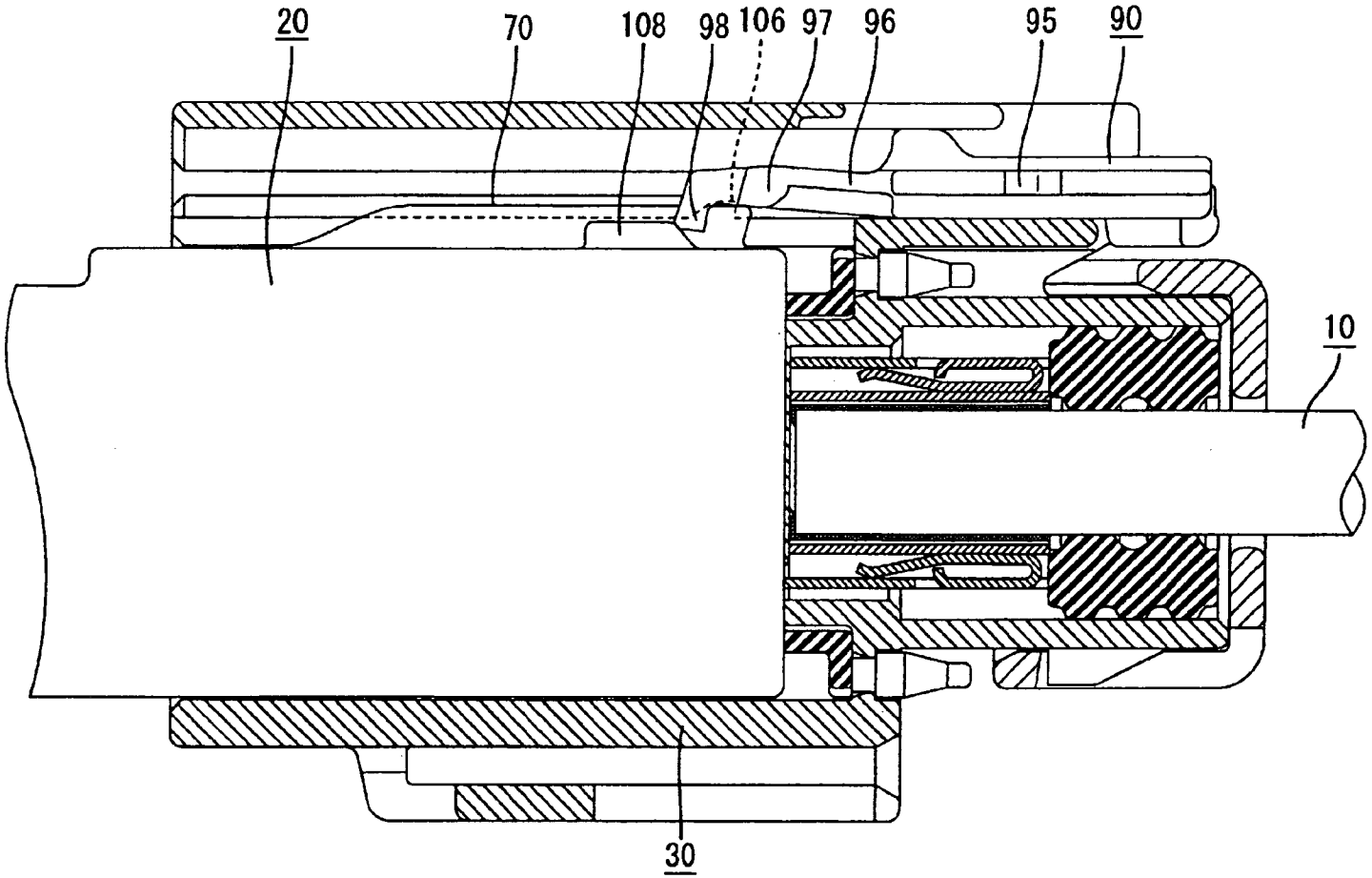
FIG. 30 is a partial vertical sectional view showing an operation of a locking piece of the detector.

Two locking pieces 96 project forward from the right and left ends of the front frame 91A of the body 91. More specifically, as shown in FIG. 30, an upper surface of each of the locking pieces 96 is flush with the sliding plate 92. Each of the locking pieces 96 is divided widthwise into an outer side and an inner side. The inner side of each locking piece 96 is longer and thicker than the outer side thereof.

A receiving wall 105 projects in from the lower end of the right and left walls of the dome 37. The outer side of the locking piece 96 is slidable on an upper surface of the receiving wall 105. However, an outer surface of the inner side of the locking piece 96 can slide along an inward projected surface of the receiving wall 105.

Figure 27:
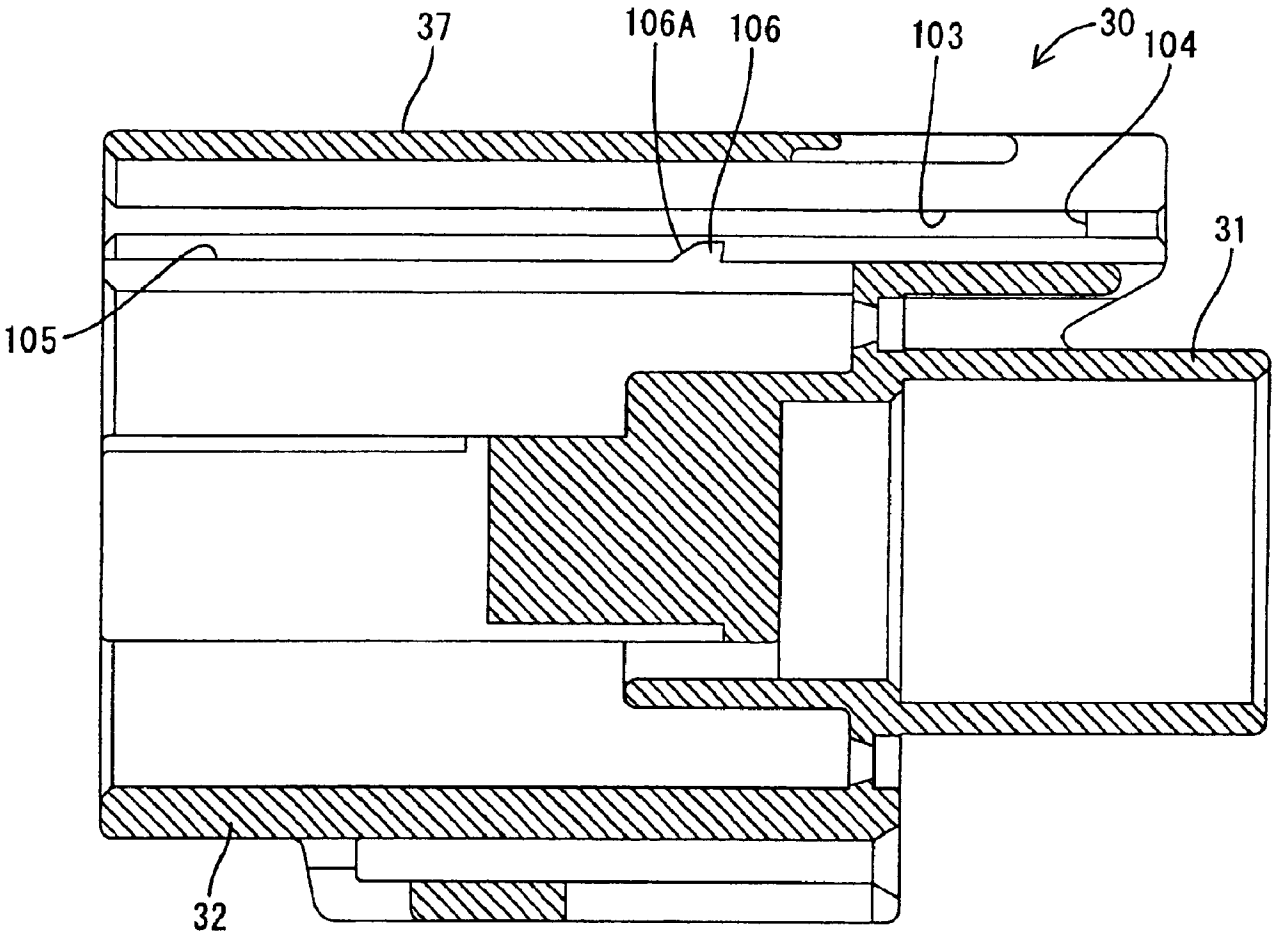
FIG. 27 is a vertical sectional view of the female housing.

A striking portion 97 is formed at the front end of the outer side of the locking piece 96 and has the shape of a downward hook. As shown in FIG. 27, a stopper 106 is formed on the upper surface of the receiving wall 105. A front surface of the stopper 106 is erect, whereas a rear surface 106A is tapered. The striking portion 97 is locked to the rear surface of the stopper 106. The striking portion 97 has a tapered locking surface that forms a semi-locking construction with the tapered surface 106A of the stopper 106.

Figure 33:
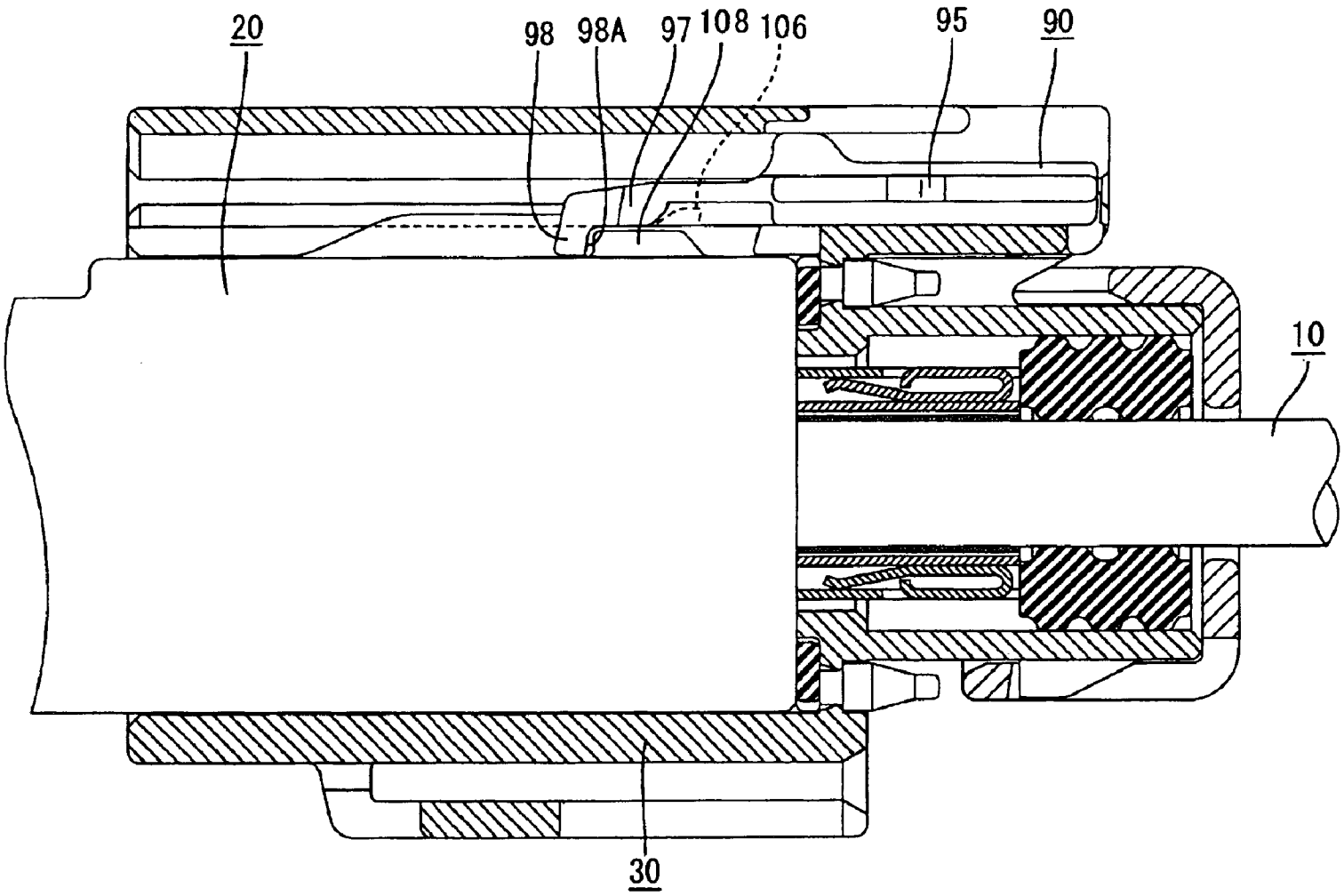
FIG. 33 is a partial vertical sectional view showing the operation of the locking piece of the detector.

A hook 98 is disposed at the front end of the inner side of the locking piece 96 and is lower than the striking portion 97. A release portion 108 is formed outward from the guide wall 71 of the male housing 20. The release portion 108 functions to lift the hook 98 of the locking piece 96, while the release portion 108 scoops the hook 98. A front surface of the release portion 108 is tapered, whereas a rear surface thereof is erect. The hook 98 is locked to the rear surface of the release portion 108. As shown in FIG. 33, the hook 98 has a gently tapered surface 98A. The corner of the rear surface of the release portion 108 is rounded to form a semi-locking construction in combination of the tapered surface 98A of the hook 98 and the rounded corner of the rear surface of the release portion 108.

In the above-described construction, the sliding plate 92 is fit into the guide groove 103 and the detector 90 is pressed forward. The striking portion 97 of the locking piece 96 then strikes the stopper 106, as shown in FIG. 25. Thereafter the projection 165 of the sliding plate 92 is locked to the locking step 104 of the guide groove 103. As a result, the detector 90 is held in a wait position without being pressed. As shown in FIG. 31, the detection projection 94 is at the wait position rearward from the rear end of the locking arm 40. Thus the rear end of the locking arm 40 can pivotally deform into the flexing space 48.

The female connector F is assembled further by inserting the female metal shell 50 into the insertion space 34 between the inner housing 31 and the outer housing 32 of the female housing 30 from the rear, as shown with arrows of FIGS. 4 and 5. Forward movement of the female metal shell 50 in the insertion space 34 presses the rib 35 into the corresponding slit 56. The rounded step 56B of the guide 56A guides the rib 35 into the slit 56 even if the female metal shell 50 is slightly misaligned with the female housing 30. Thus the female metal shell 50 is pressed straight into the insertion space 34.

The locking claw 58 reaches the locking groove 48 when the rib 35 strikes the rear end of the slit 56. Thus, as shown in FIG. 13, the locking claw 58 elastically returns to its original state and is locked to the locking groove 48. Accordingly, the female metal shell 50 is mounted on the periphery of the inner housing 31 with the rear end of the inner housing 31 approximately at the longitudinal center of the female metal shell 50, and so that the female metal shell 50 cannot slip off the inner housing 31. At this time, the front end of the female metal shell 50, including the contact plates 55, projects forward from the front end of the outer housing 32.

As shown in FIG. 13, the folded portion 57 at the front end of the female metal shell 50 contacts the peripheral surface of the inner housing 31 to form a flexing space 57A that permits the contact plate 55 to deform elastically inward.

The female terminal fittings 20 are fixed to the ends of the shielding electric wire 10 then are inserted into the cavities 33 of the female housing 30 from the rear and are locked by the respective lances 33A. Thus, the metal pipe 15 fit on the periphery of the braided wire 13 disposed at the end of each shielding electric wire 10 is elastically sandwiched elastically between the upper and lower contact pieces 54. Thereafter a waterproof rubber plug 110 is fit inside the rear end of the outer housing 32. A rubber plug hold-down member 112 prevents the waterproof rubber plug 110 from slipping off the outer housing 32. A seal ring 114 is fit on the periphery of the outer housing 32 at its front end to seal the gap between the outer housing 32 and the mating male housing 60.

The male metal shell 80 then is inserted from the rear into the insertion space 68 between the inner housing 61 and the outer housing 62 of the male housing 60, as shown with arrows of FIGS. 14 and 15. The connection ribs 69 are pressed into the corresponding slits 86 due to the forward movement of the male metal shell 80. The rounded step 87A of the guide 87 guides the ribs 69 into the slits 86 even if the male metal shell 80 is slightly misaligned with the male housing 60. Thus the male metal shell 80 is pressed straight into the insertion space 68.

The locking claws 89 move forward along the escape groove 77 and elastically deforming a little. The locking claws 89 then reach the locking hole 76 when the rib 69 strikes the rear end of the slit 86. Thus, as shown in FIGS. 1 and 21, each locking claw 89 then elastically returns to its original state and is locked to the locking hole 76. Accordingly, the male metal shell 80 is mounted on the periphery of the inner housing 61 and projects from the front and rear ends of the inner housing 61. Additionally, the male metal shell 80 cannot slip off the inner housing 61.

Because the male metal shell 80 is formed long sideways in section by press-molding one metal plate, there is a potential that it will deform and open near the widthwise center on its upper and lower surfaces. Thus, there is a possibility that the front end of the male metal shell 80 projected into the small hood 66 of the outer housing 62 remains opened because there is a clearance near the front end of the male metal shell 80. However the opening prevention ribs 79 formed on the inner peripheral surface of the small hood 66 hold down the front end of the male metal shell 80, thus keeping the male metal shell 80 in a closed state.

The male terminal fittings 25 fixed to the ends of the shielding electric wire 10 then are inserted into the cavities 63 of the male housing 60 from the rear and are locked by the lances 63A. The metal pipe 15 on the periphery of the braided wire 13 at the end of each shielding electric wire 10 is sandwiched elastically between the upper and lower contact pieces 84. Thereafter a waterproof rubber plug 78 is fitted inside the rear end of the outer housing 62. A rubber plug hold-down member 78A prevents the waterproof rubber plug 78 from slipping off the outer housing 62.

The female connector F and the male connector M then are opposed to each other, as shown in FIG. 1, and are moved toward each other. As a result, the front end of the locking arm 40 rides across the locking projection 70 of the male housing 20, as shown in FIG. 29. Thus, the female housing 30 and the male housing 20 are fit together, with the rear side of the locking arm 40 pivotally deforming into the flexing space 48. The locking arm 40 returns elastically toward its original state and is locked to the locking projection 70, as shown in FIG. 2, when the male and female connectors M and F are normally fit together.

At this time, as shown in FIGS. 30 and 33, the release portion 108 of the male housing 20 slips under the hook 98 of the locking piece 96 of the detector 90, and lifts the hook 98. Consequently the striking portion 97 escapes up from the stopper 106, and the restriction of the pressing of the detector 90 is released.

Meanwhile, the female and male terminal fittings 20 and 25 are connected together, and projected ends of the male metal shell 80 and that of the female metal shell 50 are connected. At this time, there is an increase in the resistance in fitting the female terminal fittings 20 and the male terminal fittings 25 together. Thus there is a possibility that the operation of fitting the female housing 30 and the male housing 20 together is suspended, and the female and male housings 30 and 20 are kept in a semi-fit-on state.

The rear end of the locking arm 40 is still pivotally deformed in the flexing space 48 in the semi-fit-on state. Thus, the detection projection 94 strikes the upper portion of the groove 41 disposed on the rear end of the locking arm 40. As a result, the detector 90 cannot be pressed, and it is detected that the female housing 30 and the male housing 20 are still in the semi-fit-on state. Thereafter the operation of fitting the female housing 30 and the male housing 20 together is continued.

The front end of the locking arm 40 rides across the locking projection 70 of the male housing 20 when the male and female housings 20 and 30 have been fit together normally. Thus as shown in FIG. 31, the locking arm 40 returns elastically to its original state, and the locking projection 70 is fit in the locking hole 43. Accordingly, the male and female housings 20 and 30 are locked together in a normal fit-on state.

The locking arm 40 returns to the original position when the male and female housings 20 and 30 reach the normal fit-on state, and thus the rear end of the locking arm 40 escapes up from the flexing space 48. The detector 90 then is pressed forward, and the detection projection 94 advances into the groove 41 of the locking arm 40. The detector 90 then is pressed into the detection position, as shown in FIG. 33. As a result, the striking portion 97 and the hook 98 are locked to the rear surfaces of the stopper 106 and the release portion 108 respectively. Additionally, the locking piece 96 returns elastically to its original state, and the detector 160 is held in a return-prevented state.

Accordingly, it is detected that the male and female housings 20 and 30 have been fit together normally. Further the detection projection 94 receives the pressing portion 44 of the locking arm 40 to prevent the operation of pressing the locking arm 40. In this manner, the locking arm 40 is locked doubly.

It is noteworthy that when the detector 90 is held at the detection position, as shown in FIG. 31, the edge of the inner side of the rear frame 91B of the body 91 of the detector 90 is mostly hidden under the flange 46 that projects from the rear end of the pressing portion 44 of the locking arm 40. Thus, fingers or foreign matter cannot catch by the rear frame 91B and the detector 90 cannot be returned accidentally to the wait position.

The front end of the male metal shell 80 fits on the periphery of the front end of the female metal shell 50 during the connection process. At this time, the opening prevention rib 79 holds the front end of the male metal shell 80 in the normal closed state. Thus the female metal shell 50 and the male metal shell are fitted on each other smoothly. More specifically, as shown in FIG. 2, the front end of the male metal shell 80 strikes the contact projection 56 of the contact plate 55 formed on the female metal shell 50. When the female metal shell 50 and the male metal shell are fit on each other a predetermined amount, the contact plate 55 elastically deforms in the flexing space 57A, the contact projection 56 is pressed strongly against the inner peripheral surface of the male metal shell 80 by the restoring elastic force of the contact plate 55.

In this state, the inner housing 31 of the female housing 30 fits in the fit-in concavity 65 of the outer housing 62 of the male housing 60. Thus, the female terminal fitting 20 and the male terminal fitting 25 are connected to each other. At the same time, the front end of the male metal shell 80 fits on the periphery of the front end of the female metal shell 50, and the contact plates 55 of the female metal shell 50 contact the inner peripheral surface of the male metal shell 80 elastically. As a result, the female metal shell 50 and the male metal shell 80 electrically connect and cover the connection between the female terminal fitting 20 and the male terminal fitting 25 and the metal pipes mounted on the end of the shielding electric wires 10.

As shown in FIG. 30, the release portion 108 of the male housing 20 slips under the hook 98 of the locking piece 96 at the last stage of the operation of fitting the male and female housings 20 and 30 together. Thus, the front side of the locking piece 96 is deformed elastically, and the striking portion 97 escapes up from the stopper 106. Accordingly, the restriction of the pressing of the detector 90 is released.

The detector 90 can be pressed into the wait position, with the detection projection 94 entering the groove 41 of the locking arm 40, if the female housing 30 and the male housing 20 have been fit together normally and if the locking arm 40 has returned to its original position. The operation of pressing the detector 90 forward is prevented, when the inner surface of the rear frame 91B of the body 91 strikes the rear surface of the pressing portion 44 of the locking arm 40. At this time, the locking piece 96 returns elastically to its original state. Further the striking portion 97 and the hook 98 are locked to the rear surface of the stopper 106 and to the rear surface of the release portion 108 respectively. Thus, the detector 90 is held at a detection position in a removal-prevented state.

Figure 32:
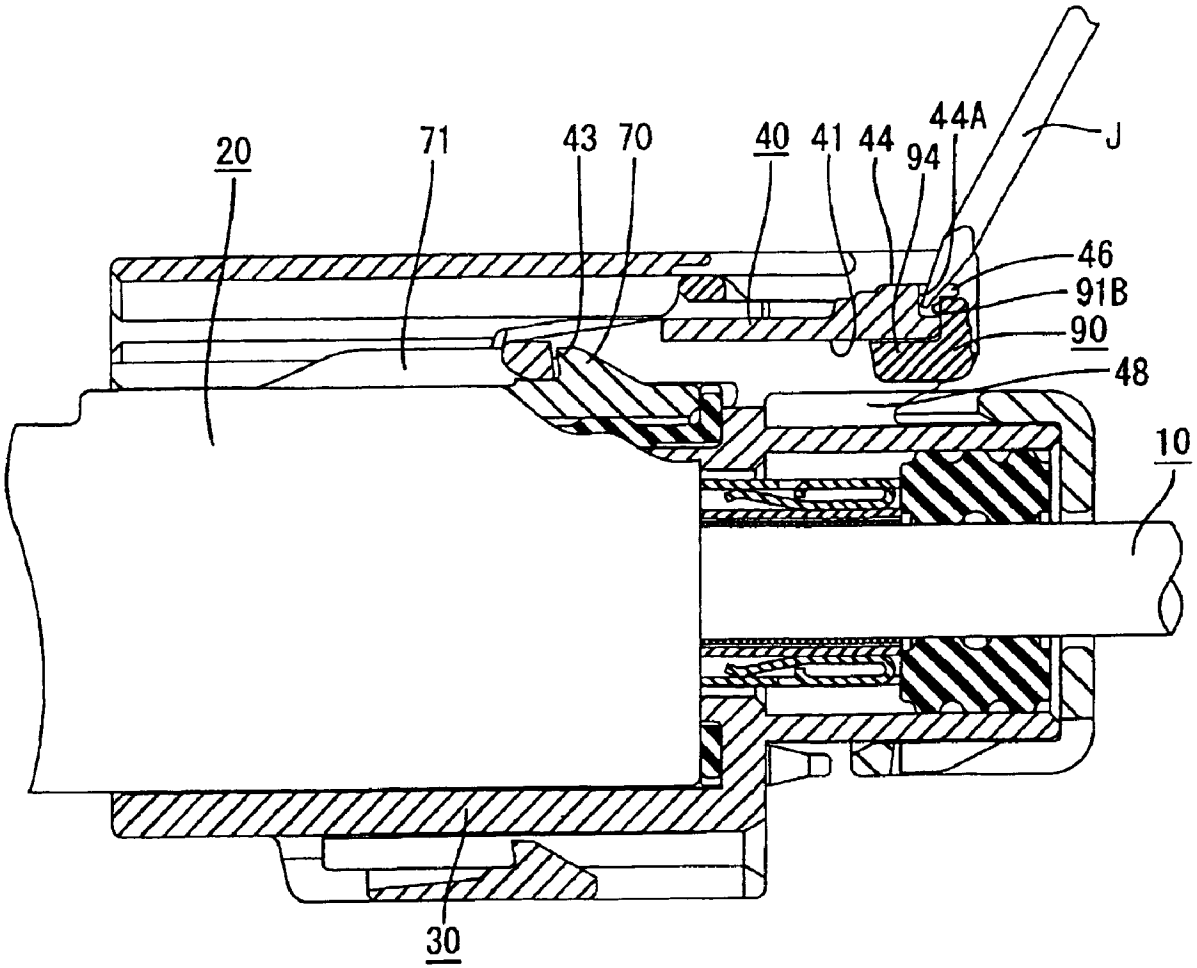
FIG. 32 is a partial vertical sectional view showing the state shown in FIG. 31.

The edge of the inner side of the rear frame 91B of the body 91 of the detector 90 at the detection position is hidden under the flange 46 projected from the rear end of the pressing portion 44 of the locking arm 40, as shown in FIG. 32.

The detector 90 is mounted on the female housing 30 at the wait position. As described previously, the rear end of the locking arm 40 at the wait position can pivotally deform into the flexing space 48, while the detection projection 94 is rearward from the rear end of the locking arm 40.

The slit 56 for receiving the rib 35 of the female metal shell 50 and the slit 86 for receiving the rib 69 of the male metal shell 80 are offset from each other in the widthwise direction of the female metal shell 50 and the male metal shell 80 so that the slits 56 and 86 do not align. Therefore, as shown in FIG. 14, the front end of the female metal shell 50 closes the slit 86, and the front end of the male metal shell 80 closes the slit 56 when the front ends of the female metal shell 50 and the male metal shell 80 are fit on each other. Accordingly, the whole region of the front end of the female metal shell 50 is covered with the male metal shell 80, and the whole region of the front end of the male metal shell 80 is covered with the female metal shell 50. Thus, shielding performance is enhanced.

The guide 57 is formed at the entrance of the slit 56 of the female metal shell 50, and the guide 87 is formed at the entrance of the slit 86 of the male metal shell 80. Thus the metal shells 50 and 80 can be fit easily on the peripheries of the inner housings 31 and 61 respectively.

The metal shells 50 and 80 are constructed of two identical split shells 51 and 81 in the form of shallow channels. The two split shells are connected to each other by caulking opposed right and left side surfaces to each other. Therefore, the female and male metal shells 50 and 80 will not open and keep their specified configuration.

The split shells 51 and 81 are smaller than the metal shell composed of one plate. Thus it is possible to adopt progressive press dies and to reduce the number of dies. Therefore it is possible to reduce the manufacturing cost.

The contact plate 55 is interposed between the female metal shell 50 and the male metal shell 80. Thus, the contact plate 55 achieves secure contact pressure and stabilizes an electrical connection between the female metal shell 50 and the male metal shell 80. Accordingly, the shielding function is enhanced.

The folded portion 57 at the front end of the female metal shell 50 contacts the peripheral surface of the inner housing 31 and forms the flexing space 55A. The contact plate 55 deforms elastically into the flexing space 55A when the female and male metal shells 50 and 80 have been fit together. The contact plate 55 contacts the inner surface of the male metal shell 80 due to the restoring elastic force of the contact plate 55.

Although the construction of the embodiment is simple, the contact plate 55 achieves appropriate flexing and a high contact pressure while reducing the resistance in fitting the female metal shell 50 and the male metal shell 80 together. Further, the strength of the front end of the female metal shell 50 is increased.

Figure 38:
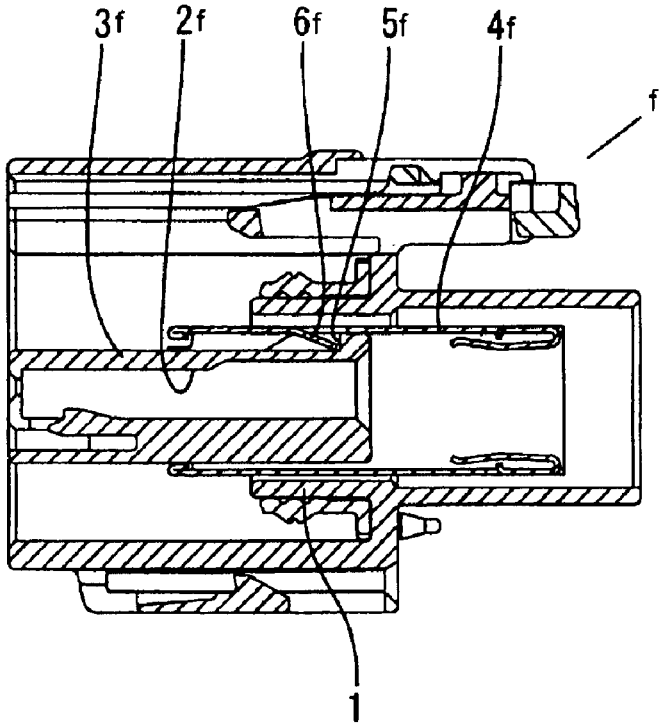
FIG. 38 PRIOR ART
FIG. 38 is a vertical sectional view showing an example of a conventional female housing and female metal shell.
Figure 39:
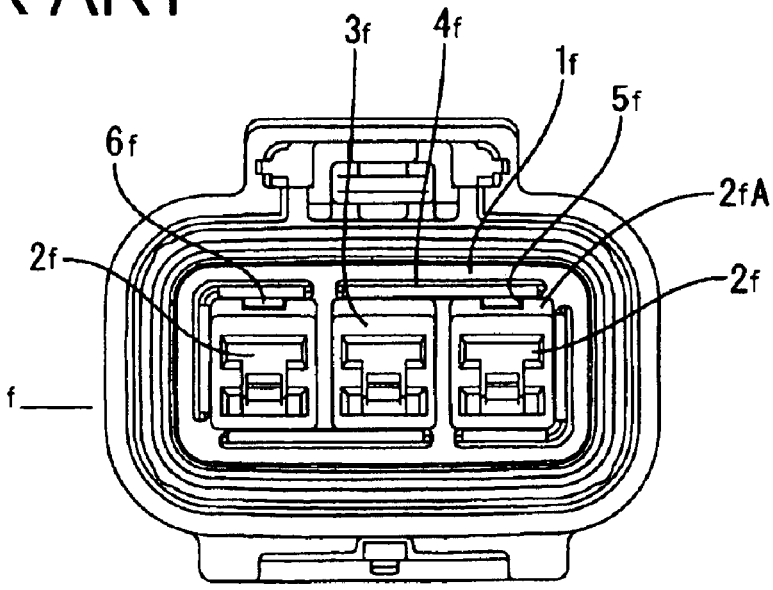
FIG. 39 PRIOR ART
FIG. 39 is a front view showing the conventional housing and shell of FIG. 38.
Figure 40:
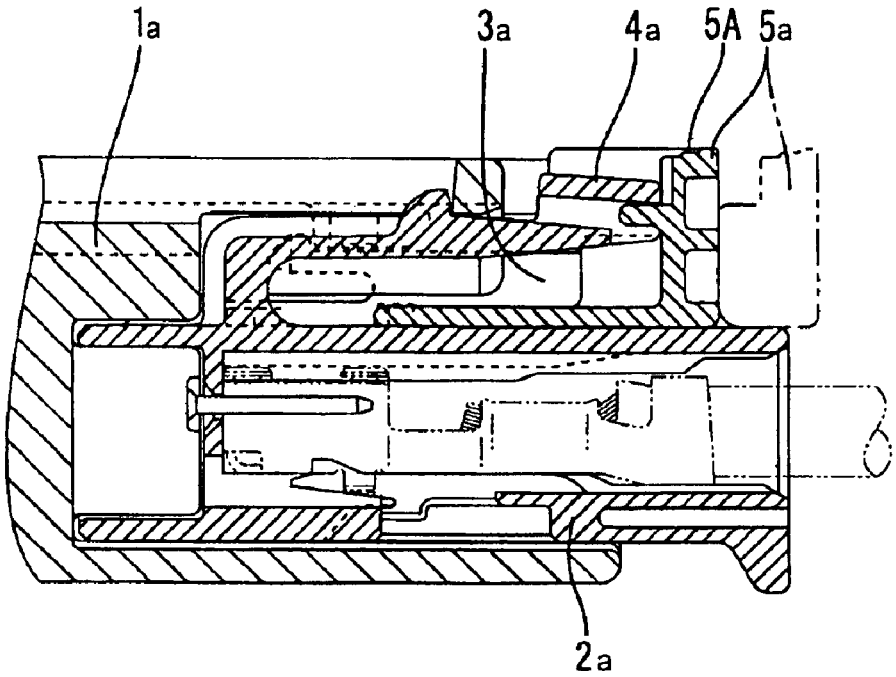
FIG. 40 is a vertical sectional view showing the known male and female housings connected.

The male and female housings 20 and 30 can be separated for maintenance by inserting the jig J into the jig insertion opening 44A, as shown in FIG. 38. The jig J then is pulled rearward, with the jig J catching the valley of the rear frame 91B of the detector 90. As a result, the detector 90 is returned to the wait position, with the semi-locking between the locking piece 96 and the stopper 106 and the release portion 108 being released.

The locking arm 40 is pivotally deformable and is unlocked by forcibly pivotally deforming it. Thus it is possible to unlock the male and female housings 20 and 30 from each other by pulling them in a move-away direction.

As described above, when the detector 90 is pressed into the detection position, the rear frame 91B is mostly hidden under the flange 46 that projects from the pressing portion 44 of the locking arm 40. Thus it is possible to prevent fingers or foreign matters from being caught by the rear frame 91B. When the detector 90 is returned intentionally to the wait position, the jig J is inserted into the jig insertion opening 44A to catch a part of the rear frame 91B with the jig J.

Thus it is possible to prevent the detector 90 from being returned accidentally and the male and female housings 20 and 30 will not be separated unintentionally.

Figure 34:
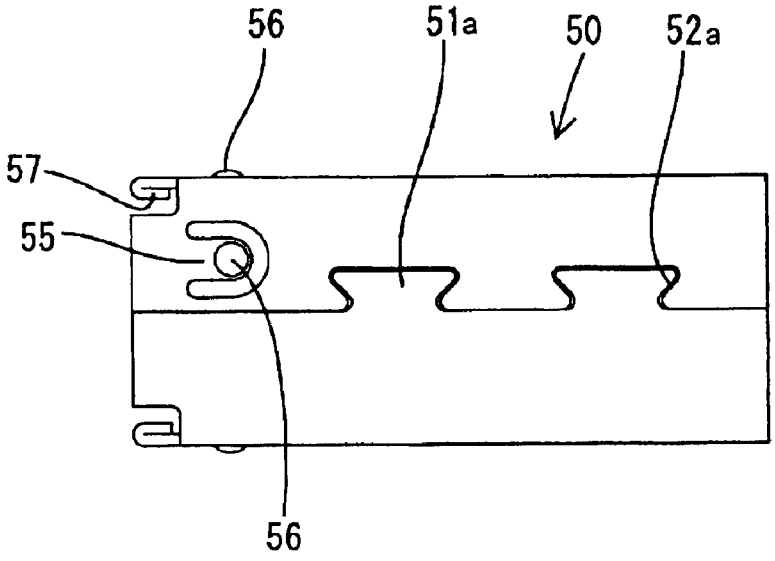
FIG. 34 is a side view of an alternate female metal shell.

An alternate female metal shell 50*a* is shown in FIG. 34. Dovetail projections 52*a* dovetail recesses 53*a* are formed in opposed edges of the female metal shell 50*a* to connect the edges thereof. In all other respects, the female metal shell 50*a* is the same as the female metal shell 50. The male shell can have similar dovetail projections and dovetail recesses.

Figure 35:
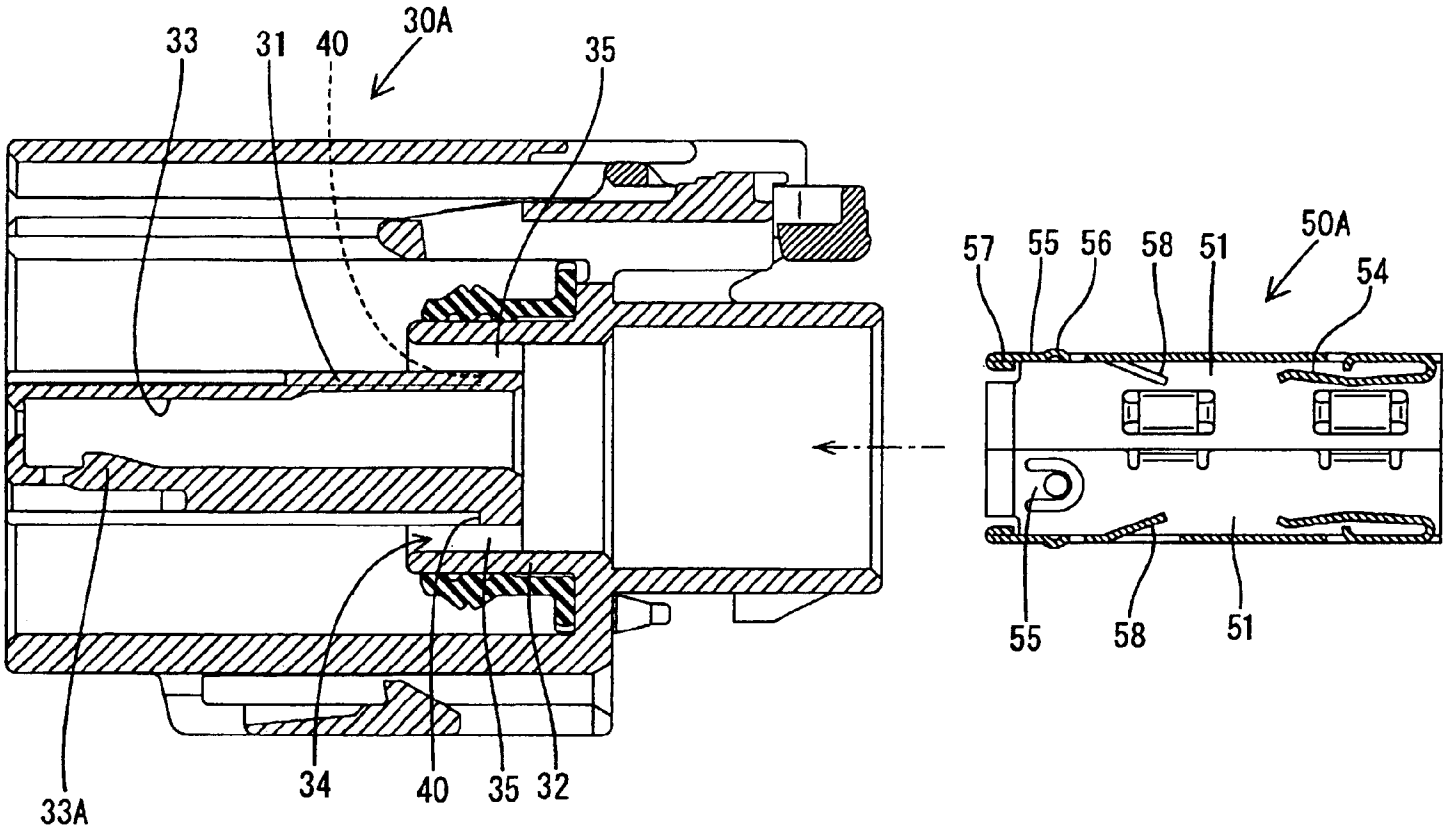
FIG. 35 is an exploded sectional view showing a female metal shell on a female housing according to another embodiment of the invention.
Figure 36:
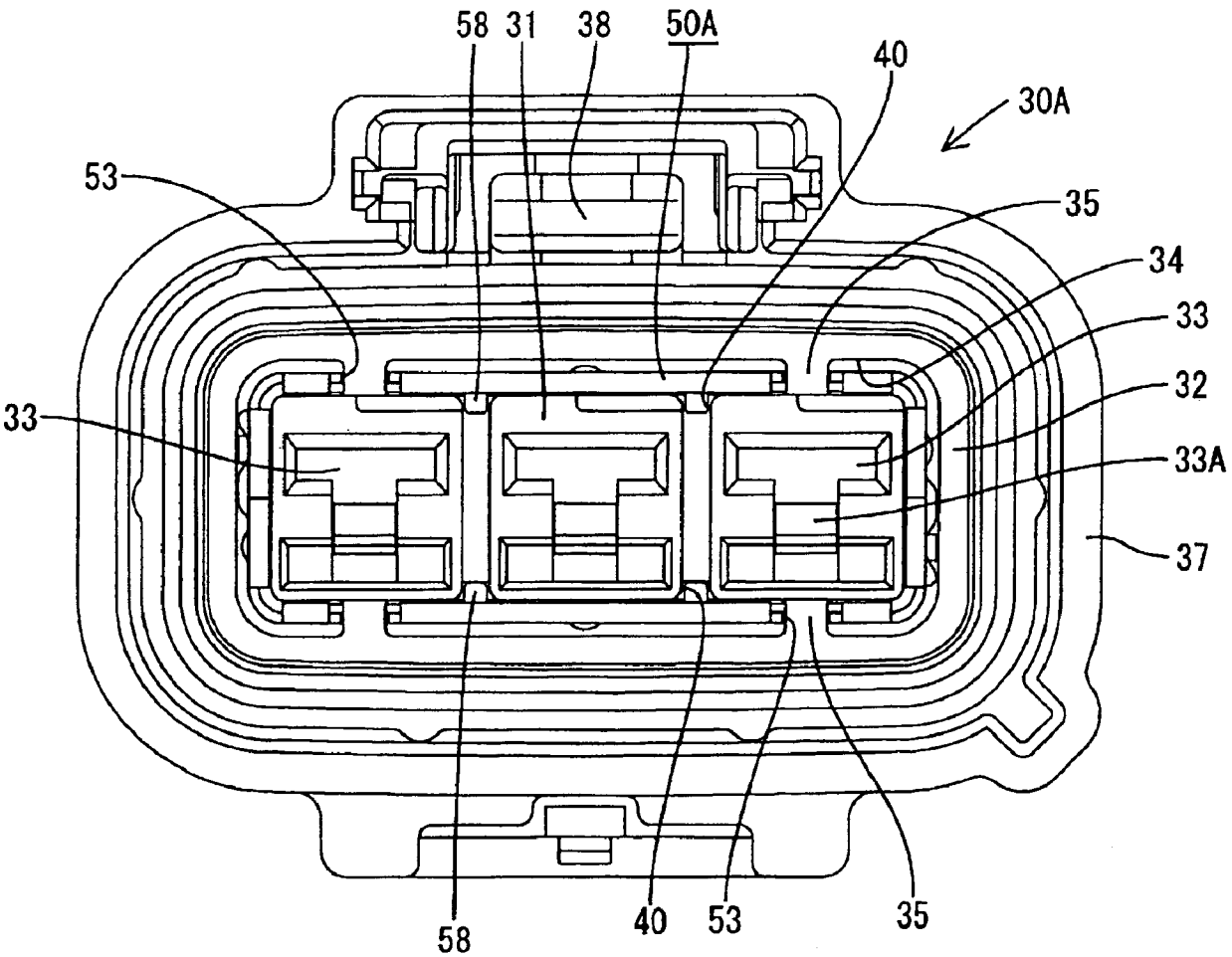
FIG. 36 is a front view showing the female housing of FIG. 35 in which the female metal shell has been mounted.
Figure 37:
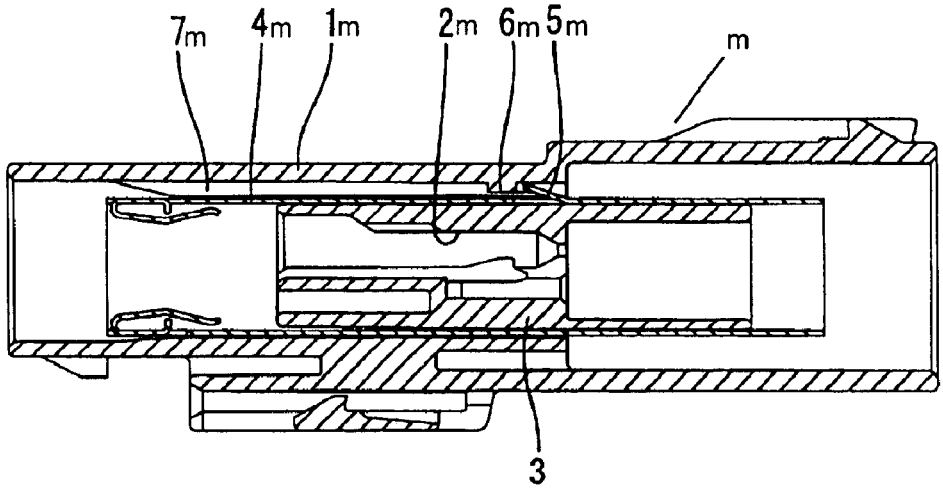
FIG. 37 PRIOR ART
FIG. 37 is a vertical sectional view showing an example of a conventional male housing and male metal shell.

An alternate female housing 30A is shown in FIGS. 35 and 36. The female housing 30A has locking grooves 40A formed on the inner housing 31 for receiving the locking claws 58. The locking grooves 40A are open at the front side. As shown in FIG. 36, each locking groove 40A is disposed between the adjacent cavities 33A. The locking grooves 40A for engaging the locking claws 58 utilize the dead space between the adjacent cavities 33. This differs from the conventional art of forming the locking portion on the outer wall of the cavity. Thus, it is unnecessary to thicken the peripheral wall of the outer housing 62, and the female housing 30 is compact radially.

The invention is not limited to the embodiment described above with reference to the drawings. For example, the following embodiments are included in the technical scope of the present invention. Further, various modifications of the embodiments can be made without departing from the spirit and scope of the present invention.

The metal shell is not limited to the split type described in the embodiment, but may be constructed of one plate.

The present invention is applicable to a non-waterproof shielding connector and a shielding connector that is directly connected to equipment.

The locking hole is formed in the region of the bottom wall of the flexing space against which the lance does not strike. However, the locking hole may be extended in such a way that the lance strikes a part of the locking hole. In this case, the locking hole, namely, the locking claw can be widely formed to enhance the force of locking the metal shell.

The metal shell is applicable to a connector in which the male housing has the locking arm and the detector.

The detector is not limited to the shielding connector, but is applicable to other connectors for detecting connection between the male housing and the female housing.

What is claimed is:

1. A shielding connector having a female housing and a male housing to be fitted on said female housing, each of said female and said male housings comprising:

an outer housing and an inner housing suspended in the outer housing by a connection, the inner housing accommodating terminal fittings connected to an end of a shielding electric wire; and a metal shell having a rear end for contacting a braided wire of said shielding electric wire, the metal shell being inserted into a rear end of said outer housing and being mounted on a periphery of said inner housing, the metal shell having a front end with at least one slit for receiving said connection, a resiliently deformable contact plate being raised from said female metal shell at a portion near said front end of said female metal shell and projecting outwardly towards said male metal shell for contacting an inner surface of said male metal shell, said front end of said female metal shell forward from said contact plate being folded inwardly to contact a peripheral surface of said inner housing on which said female metal shell is mounted, wherein said female and male housings being fit together so that the respective terminal fittings thereof are connected, and so that projected ends of said metal shells of said female and male housings telescope together and cover the connection between the respective terminal fittings for electromagnetically shielding said terminal fittings, and said slits of said metal shells of said female and male housings being offset from each other.

2. The shielding connector of claim 1, wherein each of said metal shells has guides adjacent the respective slits for guiding the connections into the respective slits.

3. The shielding connector of claim 1, wherein each of said metal shells is composed of two split shells; joining portions being formed on mating surfaces of said two split shells.

4. A shielding connector having a housing with an inner housing having cavities for receiving terminal fittings connected to ends of a shielding electric wire, a lance formed in each said cavity of said inner housing for locked engagement with a corresponding one of the terminal fittings, a space disposed adjacent the lance for permitting resilient deflection of the lance in response to insertion of the terminal fitting into the respective cavity, a metal shell mounted on a periphery of said inner housing and configured for contacting braided wires of said shielding electric wire, wherein locking claws are projected inwardly from an inner surface of said metal shell; and locks are formed concavely on said periphery of said inner housing for unremovably engaging the locking claws, the locks being formed concavely on said periphery of said inner housing at a location communicating with the deformation spaces for said lances for reducing crops-sectional dimensions of said housing.

5. The shielding connector of claim 4, wherein the locks are formed between adjacent cavities of the inner housing.

6. The shielding connector of claim 5, wherein said locks are formed on opposed peripheral surfaces of said inner housing.

7. In a shielding connector comprising a female housing having a front end and a male housing having a front end to be fitted on said front end of said female housing, said female housing and said male housing having:

female and male inner housing respectively accommodating female and male terminal fittings connected to ends of shielding electric wires; and female and male metal shells having rear ends for contacting braided wires of said shielding electric wires and having front ends opposite from said rear ends, said female and male metal shells being mounted, respectively, on peripheries of said female and male inner housings, said female and male terminal fittings being connected together when said female and male housings are fit together, and projected portions of said female and male metal shells adjacent the front ends of said female and male metal shells covering areas of connection between said female and male terminal fittings and electromagnetically shielding said female and male terminal fittings, wherein said male housing has an opening prevention portion that contacts an outer surface of said projected portion adjacent the front end of said male metal shell and prevents the projected portion adjacent the front end of said male metal shell from opening.

8. The shielding connector of claim 7, wherein a resiliently deformable contact plate is raised from said female metal shell at a portion near said projected end of said female metal shell for contacting an inner surface of said male metal shell; and said projected end of said female metal shell forward from said portion where said contact plate is formed inward to contact a peripheral surface of said inner housing on which said female metal shell is mounted.

9. A connector having first and second housings to be fitted together, the first housing comprising:

a locking arm having a support that deforms elastically, the locking arm having a locking portion cantilevered forwardly from said support and a pressing portion cantilevered rearwardly from said support, said pressing portion moving into a flexing space, rearward of the support while said housings are being fit together and the support returns resiliently to an original state for locked engagement of the locking portion with the second housing when said housings have been fitted together for holding said housings in a fit-on state; and a detector that is movable between a wait position disposed away from said flexing space and a detection position inside said flexing space, said detector striking said locking arm that has entered said flexing space while said housings are being fitted together for preventing said detector from entering said detection position from said wait position; said detector being permitted to advance to said detection position when said housings have been fit together normally, said detector having a catch for returning said detector to said wait position, said catch being hidden in abutting relationship to said pressing portion at a rear side of said locking arm except a portion of said catch that is spaced from said pressing portion sufficiently to be caught by a jig when said detector is at said detection position.

10. The connector of claim 9, wherein a resiliently deformable locking piece is formed on said detector and is locked to a lock on said first housing, whereby said detector is prevented from moving from said wait position to said detection position before said housings are fit together; and said second housing has a release portion that engages said locking piece and deforms said locking piece, when said housings are fit together, thus unlocking said locking piece from said lock.

* * * * *